US008870981B2

(12) United States Patent
Papachristos et al.

(10) Patent No.: US 8,870,981 B2
(45) Date of Patent: Oct. 28, 2014

(54) ADDITIVE FUEL COMPOSITION, AND METHOD OF USE THEREOF

(71) Applicants: Miltiades Papachristos, Thessaloniki (GR); Ian Malcolm McRobbie, Chester (GB); Deepak Kamran, Singapore (SG)

(72) Inventors: Miltiades Papachristos, Thessaloniki (GR); Ian Malcolm McRobbie, Chester (GB); Deepak Kamran, Singapore (SG)

(73) Assignee: Innospec Limited (GB)

( * ) Notice: Subject to any disclaimer, the term of this patent is extended or adjusted under 35 U.S.C. 154(b) by 0 days.

(21) Appl. No.: 13/676,234

(22) Filed: Nov. 14, 2012

(65) Prior Publication Data

US 2013/0183628 A1 Jul. 18, 2013

Related U.S. Application Data

(63) Continuation of application No. 12/523,008, filed as application No. PCT/GB2008/000101 on Jan. 11, 2008, now abandoned.

(30) Foreign Application Priority Data

Jan. 11, 2007 (GB) ..... 0700534.1

(51) Int. Cl.
*C10L 1/30* (2006.01)
*C10L 1/14* (2006.01)

(Continued)

(52) U.S. Cl.
CPC . *C10L 1/305* (2013.01); *C10L 1/19* (2013.01); *C10L 1/1855* (2013.01); *C10L 1/1608* (2013.01); *C10L 1/143* (2013.01); *C10L 1/1966* (2013.01); *C10L 1/1981* (2013.01);

(Continued)

(58) Field of Classification Search
CPC ..... C10L 1/305; C10L 1/143; C10L 10/00; C10L 10/02
USPC ..... 44/358, 359, 360, 361, 362, 363, 450, 44/457
See application file for complete search history.

(56) References Cited

U.S. PATENT DOCUMENTS 2,680,756 A 6/1954 Pauson
2,769,828 A 6/1956 Sieg (Continued)

FOREIGN PATENT DOCUMENTS

CA 2268821 A1 4/1998
CN 1041387 A 4/1990

(Continued)

OTHER PUBLICATIONS

Giordano, P.J., et al. "Photosubstitution Behavior of Dicarbonyl (n5-cyclopentadienyl) pyridinomanganese and -rhenium and Related Complexes." Contribution from the Department of Chemistry, Massachusetts Institute of Technology, Cambridge, MA 02139 Inorganic Chemistry, vol. 16, No. 1, 1977.

(Continued)

*Primary Examiner* — Cephia D Toomer
(74) *Attorney, Agent, or Firm* — Burns & Levinson, LLP; Janine M. Susan

(57) ABSTRACT

An additive composition for a fuel comprises:
(i) a metal compound selected from an iron compound, a manganese compound, a calcium compound, a cerium compound and mixtures thereof;
(ii) an organic compound selected from a bicyclic monoterpene, substituted bicyclic monoterpene, adamantane, propylene carbonate and mixtures thereof; and
(iii) a stabilizer.
The additive composition allows fuels which are prone to separation, for example blended fuels or fuels having a high content of asphaltenes, to be used successfully.

16 Claims, 1 Drawing Sheet

(51) Int. Cl.

| | |
|---|---|
| ***F23J 7/00*** | (2006.01) |
| ***C10L 10/00*** | (2006.01) |
| ***C10L 10/02*** | (2006.01) |
| *C10L 1/19* | (2006.01) |
| *C10L 1/185* | (2006.01) |
| *C10L 1/16* | (2006.01) |
| *C10L 1/196* | (2006.01) |
| *C10L 1/198* | (2006.01) |
| *C10L 1/236* | (2006.01) |
| *C10L 1/238* | (2006.01) |
| *C10L 1/183* | (2006.01) |
| *C10L 1/197* | (2006.01) |
| *C10L 1/24* | (2006.01) |

(52) U.S. Cl.

CPC ..... *C10L 1/2364* (2013.01); *F23J 7/00* (2013.01); *C10L 1/238* (2013.01); *C10L 1/1852* (2013.01); *C10L 10/00* (2013.01); *C10L 1/2368* (2013.01); *C10L 1/1832* (2013.01); *C10L 10/02* (2013.01); *C10L 1/1973* (2013.01); *C10L 1/2475* (2013.01); *C10L 1/1857* (2013.01)

USPC ..... 44/358; 44/359; 44/360; 44/361; 44/362; 44/363; 44/450; 44/457

(56) References Cited

U.S. PATENT DOCUMENTS

| | | | | |
|---|---|---|---|---|
| 2,804,468 | A | | 8/1957 | Arimoto |
| 2,818,417 | A | | 12/1957 | Brown et al. |
| 2,834,796 | A | | 5/1958 | Barusch et al. |
| 2,868,816 | A | | 1/1959 | Petree |
| 2,898,354 | A | | 8/1959 | Hymin et al. |
| 2,898,360 | A | | 8/1959 | Paul et al. |
| 2,959,603 | A | | 11/1960 | Gould et al. |
| 2,959,604 | A | | 11/1960 | Brown et al. |
| 2,960,514 | A | | 11/1960 | Brown et al. |
| 2,987,529 | A | | 6/1961 | Sims |
| 3,007,953 | A | | 11/1961 | Closson et al. |
| 3,042,693 | A | | 7/1962 | Coffield et al. |
| 3,127,351 | A | | 3/1964 | Brown et al. |
| 3,437,634 | A | | 4/1964 | Neuse |
| 3,925,031 | A | | 12/1975 | Villacampa |
| 3,961,916 | A | | 6/1976 | Ilnyckyj et al. |
| 4,265,639 | A | | 5/1981 | Scholtz |
| 4,370,147 | A | | 1/1983 | Kenny et al. |
| 4,389,220 | A | | 6/1983 | Kracklauer |
| 5,073,248 | A | | 12/1991 | Stephenson et al. |
| 5,116,390 | A | | 5/1992 | Rodriguez |
| 5,143,594 | A | * | 9/1992 | Stephenson et al. ..... 208/48 AA |
| 5,494,607 | A | | 2/1996 | Manek et al. |
| 6,270,653 | B1 | | 8/2001 | Gochin et al. |
| 6,948,926 | B2 | | 9/2005 | Valentine et al. |
| 7,959,693 | B2 | * | 6/2011 | Parish et al. ..... 44/626 |
| 2006/0196108 | A1 | | 9/2006 | Blanchard |
| 2006/0196109 | A1 | | 9/2006 | Morton et al. |
| 2006/0218855 | A1 | | 10/2006 | Asbahr et al. |

FOREIGN PATENT DOCUMENTS

| | | | | |
|---|---|---|---|---|
| CN | 1325945 | A | | 12/2001 |
| CN | 1428404 | A | | 7/2003 |
| CN | 1546615 | A | | 11/2004 |
| CN | 1597873 | A | | 3/2005 |
| CN | 1715375 | A | | 1/2006 |
| CN | 1718699 | A | | 1/2006 |
| DE | 2147994 | A1 | | 3/1972 |
| DE | 3031158 | A1 | | 1/1982 |
| DE | 3418648 | A1 | | 11/1985 |
| DE | 20110995 | U1 | | 1/2002 |
| DE | 10208326 | A1 | | 9/2003 |
| EP | 0078249 | A | | 5/1983 |
| EP | 0193753 | A | | 9/1986 |
| EP | 0435631 | A | | 7/1991 |
| EP | 0476196 | A | | 3/1992 |
| EP | 0743972 | A1 | | 11/1996 |
| EP | 0743974 | A1 | | 11/1996 |
| EP | 0946679 | A1 | | 10/1999 |
| EP | 1323812 | A | | 7/2003 |
| EP | 1612256 | A1 | | 1/2006 |
| GB | 1167427 | A | | 10/1969 |
| GB | 1171648 | A | | 11/1969 |
| GB | 2248068 | A | | 3/1992 |
| GB | 2254610 | A | | 10/1992 |
| GB | 0733129 | A1 | | 9/1996 |
| GB | 0763550 | A1 | | 3/1997 |
| WO | 8701720 | A1 | | 3/1987 |
| WO | 9220762 | A1 | | 11/1992 |
| WO | 9904138 | A1 | | 1/1999 |
| WO | 9936488 | A1 | | 7/1999 |
| WO | 9409091 | A1 | | 4/2001 |
| WO | 0212417 | A1 | | 2/2002 |
| WO | 02/18398 | A1 | | 3/2002 |
| WO | 0218298 | A1 | | 3/2002 |
| WO | 03020733 | A1 | | 3/2003 |
| WO | WO2006196109 | | * | 9/2006 |
| WO | 2007007191 | A1 | | 1/2007 |
| WO | WO2007007191 | | * | 1/2007 |
| WO | 2007062330 | A1 | | 5/2007 |
| WO | 2008084251 | A1 | | 7/2008 |

OTHER PUBLICATIONS

Kirk-Othmer, Encyclopedia of Chemical Technology, Fourth Edition, vol. 8 Deuterium and Tritium to Elastomers, Polyethers, A Wiley-Interscience Publciation, John Wiley & Sons, pp. 432-445 (date unknown).

"Petroleum products—Transparent and opaque liquids—Determination of kinematic viscosity and calculation of dynamic viscosity," (ISO 3104:1994), Kinematic Viscosity, IP71 Section 1 (1996).

Ritcher, J. "Neue Ergebnisse zur Regeneration von Dieselpartikelfiltern mit Additiven," BeratungsgeMineraloel—Technik, vol. 43, No. 7, Jul. 1998.

Database WPI Week, 200518, Derwent Publications Ltd., London, GB; AN 2005-164039 XP002407736 & CN 1 544 583 A (Harbin Honghao New Energy Ind. Co., Ltd., Nov. 10, 2004, Abstract.

Database WPI Week 200235, Derwent Publications Ltd., London, GB; AN 2002-305334 XP002407734 CN 1 325 945 A (LI H), Dec. 12, 2001, Abstract.

Database WPI Week 199842; Derwent Publications Ltd., London, GB; AN 1998-493555 XP002407735 & RU 2 105 041 C1 (Ilin A. P.), Feb. 20, 1998, Abstract.

Richter, J. "Regeneration von Partikelfiltern mit Additiven," Fuels 1999, 2nd International Colloquium, 20-21.01, 1999: 489-495.

Kealy, T. J. et al. "A New Type of Organo-Iron Compound," Nature, No. 4285, Dec. 15, 1951, vol. 168: 1039-1040.

International Search Report and Written Opinion dated May 16, 2008 for PCT/GB08/00101.

Translation of Cover Page and Text of First Office Action issued by the State Intellectual Property Office, P.R. China, for Patent Appl. No. 200880002166.X dated May 24, 2012.

* cited by examiner

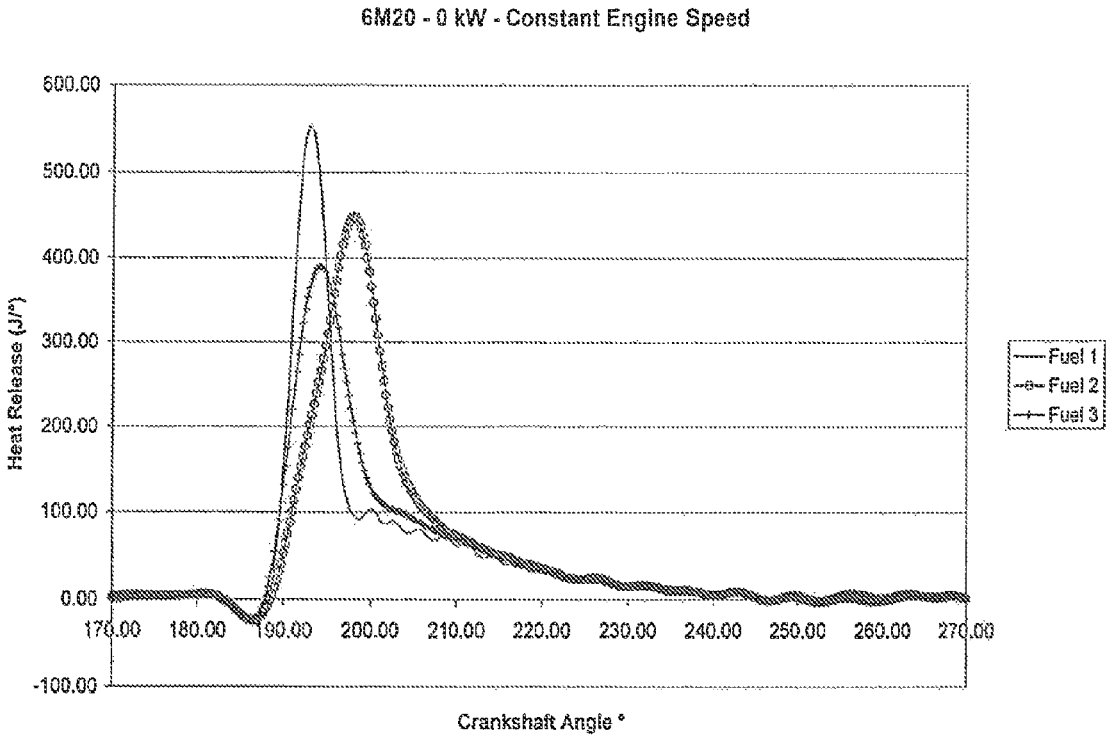
6M20 - 0 kW - Constant Engine Speed
600.00
500.00
400.00
300.00
200.00
100.00
0.00
-100.00
Heat Release (J/°)
170.00
180.00
190.00
200.00
210.00
220.00
230.00
240.00
250.00
260.00
270.00
Crankshaft Angle °
Fuel 1
Fuel 2
Fuel 3

ADDITIVE FUEL COMPOSITION, AND METHOD OF USE THEREOF

CROSS-REFERENCE TO RELATED APPLICATIONS

This application is a continuation of co-pending U.S. patent application Ser. No. 12/523,008 entitled COMPOSITION, METHOD AND USE, which in turn is a U.S. national stage application under 35 U.S.C. 371 of International Application No. PCT/GB2008/000101 filed Jan. 11, 2008, which in turn claims priority to Great Britain Application No. 0700534.1 filed Jan. 11, 2007, all of which are incorporated herein in their entirety and for all purposes.

BACKGROUND OF THE INVENTION

As crude oil prices rise, all downstream products become more expensive—for example fuel for heating, power stations and vehicles, especially ships.

More highly refined or "lighter" fuels are more expensive than less highly refined or "heavier" fuels. The latter tend to be less favoured for use. They are more viscous and tend to burn "dirtier". They are more prone to separation or sedimentation during transportation, blending or storage. By "dirtier", we mean that the less highly refined fuels contain a higher concentration of unstable components or compounds than more highly refined fuels. Such components or compounds promote the formation of sediment or sludge within the fuel. Further, it is believed that such components or compounds lead to deleterious carbon formation on combustion, leading, inter alia, to deposition on fuel injector, combustion and reduced efficiency in waste heat recovery.

It many commercial haulage sectors the fuel cost is a major part of the total operating cost. In the case of commercial shipping, for example, it is estimated that the fuel cost sometimes amounts to 70% of the total operating cost of the ship.

Therefore there is often a strong economic driver to move to less refined fuels but the adverse consequences, mentioned above, inhibit it. Ship operators, for example, cannot tolerate addition down-time whilst ships' engines and associated equipment are cleaned of soot (i.e. carbon) deposits. Moreover many ships cannot have visible smoke exhaust streams. This would be unacceptable on cruise ships, and may in any case not satisfy environmental laws in countries, which ships may dock.

Blended fuels—for example conventional diesel and biodiesel, and different grades of conventional fuel oil—may also suffer from problems of instability. This is a particular problem when ships buy fuel on the spot market, and the purchased fuel is added to fuel remaining in its fuel store. The result may be problems in pumping and/or combustion.

It would be desirable to have an additive composition which reduces or overcomes such problems.

SUMMARY OF THE INVENTION

The present invention relates to an additive composition for fuel, a fuel composition, and methods and uses of such a composition. In particular, the present invention relates to an additive composition which may be used to achieve improved fuel economy and to permit heavier and/or dirtier fuels to be used in place of lighter and/or cleaner fuels.

It is an object of embodiments of the invention to provide an additive composition which provides benefits in the utilisation of fuel having a viscosity which is as low as 1 cSt at 40° C.

It is an object of embodiments of the invention to provide an additive composition which provides benefits in the utilisation of fuel having a viscosity which is as high as 1000 cSt at 40° C.

It is an object of embodiments of the invention to provide an additive composition which permits a heavier fuel to be used in a situation in which a lighter fuel would previously have been used; with reduction or avoidance of adverse consequences which might otherwise have been expected; in particular with reduction or avoidance of deleterious carbon formation, leading for example to carbon deposition and/or exhaust smoking.

It is an object of embodiments of the invention to improve the stability of fuel which may otherwise suffer from stability problems, for example phase separation, or separation or aggregation of polyaromatic compounds within the fuel, or sedimentation.

It is an object of embodiments of the invention to improve the delivery of a fuel to the site of combustion, for example by improving its flow properties.

It is an object of embodiments of the invention to improve the delivery of a fuel to the site of combustion, for example in terms of its evenness or cleanness of combustion.

The additive composition of the present invention contains a metal compound (as later defined), which may be ferrocene.

Ferrocene and its derivatives are known from the literature. Ferrocene and its manufacture were described for the first time in Nature 168 (1951), Page 1039. Since then, ferrocene and its derivatives as well as corresponding manufacturing procedures have been the object of numerous patents, e.g. U.S. Pat. No. 2,769,828, U.S. Pat. No. 2,834,796, U.S. Pat. No. 2,898,360 and U.S. Pat. No. 3,437,634.

In addition to many other compounds, DE 34 18 648 names ferrocene (dicyclopentadienyl iron) as a possible additive in order to optimise combustion of heating oil. This optimised combustion encourages complete combustion of the heating oil.

In U.S. Pat. No. 4,389,220, a two stage process for conditioning a diesel motor is described. According to this patent, an initial high dosage of ferrocene, 20 to 30 ppm, in the diesel fuel can remove carbon deposits in the combustion chamber and also deposit a layer of catalytic iron oxide on the combustion surfaces. Subsequently, a lower dosage of ferrocene, 10 to 15 ppm, maintains this catalytic iron oxide coating. At the same time it was found that with these measures, fuel consumption is lower by up to 5%. As it is difficult to add organic iron compounds such as ferrocene to fuels in solid form, concentrated solutions are generally used.

The additive composition of the present invention contains an organic compound (as later defined), which may be camphor.

DE 30 31 158 A1 teaches that a mixture consisting of 70 to 85% of water by volume and 0.1 to 1% of camphor can be added to heating oil immediately before combustion.

DE 21 47 994 teaches that additives which among others contain camphor can be used in the combustion air of internal combustion engines.

U.S. Pat. No. 3,925,031 teaches that an additive which contains camphor and naphthalene among others can be added to a gasifier fuel, a diesel fuel or a lubricating oil.

In the art, camphor has been used in fuel to provide a reduction in either fuel consumption or hazardous emissions. However, camphor is not known to reduce soot. Rather, as discussed in U.S. Pat. No. 5,116,390, a disadvantage of using camphor is that additional soot formation is noted on burning fuel that contains camphor as an additive. Similarly, U.S. Pat. No. 3,925,031 teaches that use of camphor in gasoline in sufficient quantities to increase the effective octane rating of the gasoline also results in a reduction of combustion efficiency and a corresponding increase in the quantity of unburned carbon, leading to sooty exhaust particles.

It is also known that combustion catalysts can lead to the production of ash, see for example U.S. Pat. No. 6,948,926. Thus, additives which reduce soot formation may lead to an increase in the formation of ash. H. Jungbluth, B. Richter, "Neue Ergebnisse zur Regeneration von Dieselpartikelfiltern mit Additiven", Mineralöltechnik, July 1998; Regeneration von Partikelfiltern mit Additiven, FUELS 1999, 2nd International Colloquium, 20-21 Jan. 1999, page 489-495, shows how using such additives in the fuel of heavy duty diesel engines provides an increased peak in the emissions caused by the ash derived from combustion of the additive.

CN 1597873 discloses a fuel which includes methanol, hydrogen peroxide, ferrocene and camphor that reduces the harmful emissions.

The additive composition of the present invention contains a stabiliser.

To disperse asphaltenes in a fuel various proposals have been made. For example:

U.S. Pat. No. 5,073,248 describes the use of secondary alkanesulphonic acids as asphaltene-dispersing agents. The compositions can further contain: 1. alkylphenol formaldehyde resins, 2. oxalkylated amines, 3. wax-dispersing agents.

EP0946679A describes the use of sarcosinates as asphaltene dispersants. The sarcosinate stabiliser can be combined with alkylphenol formaldehyde resins, oxyalkylated amines, and sulphonic acid.

WO9904138 describes the use of ether carboxylic acids as asphaltene dispersants in crude oils:

U.S. Pat. No. 5,494,607 describes the use of alkyl substituted phenol-polyethylenepolyamine-formaldehyde resins as asphaltene dispersants.

U.S. Pat. No. 6,270,653 describes a method of controlling asphaltene precipitation in a fluid, and covers chemicals with a functional group capable of interacting with asphaltenes and an alkyl group extending out into the solution phase: X—R, where X is preferably an aromatic group and R contain 10-25 carbon atoms.

In one aspect the present invention provides an additive composition for a fuel comprising:

(i) a metal compound selected from an iron compound, a manganese compound, a calcium compound, a cerium compound and mixtures thereof;

(ii) an organic compound selected from a bicyclic monoterpene, a substituted bicyclic monoterpene, adamantane, propylene carbonate and mixtures thereof; and (iii) a stabiliser.

A stabiliser herein may suitably be selected from an asphaltene dispersant, a wax anti-settling agent, a cold flow improver, a fuel antioxidant, a biofuel instability inhibitor or a blended fuel separation inhibitor. Other agents which promote stability of the composition are not excluded.

In a further aspect the present invention provides a fuel composition comprising an additive composition of the present invention and a fuel. Suitably the fuel is a hydrocarbon fuel. It may be a petroleum or distilled fuel. It may be a fuel selected from diesel, marine fuel, bunker fuel, heating oil, middle distillate oil and heavy fuel oil; and including GTL (gas-to-liquid), CTL (coal-to-liquid), BTL (biomass-to-liquid), and OTL (oil sands-to-liquid); or from mixtures thereof (where appropriate).

The fuel may be a so-called recovered fuel or biofuel, for example biodiesel.

The fuel may be a fuel which is prone to separation or sedimentation during transportation or storage.

The fuel may be a blended fuel in which the components in the blend are not wholly compatible.

The fuel may be a fuel which is prone be instability as a result of oxidation.

The fuel may be a fuel which is prone to freezing, wholly or partially, under ambient conditions.

The fuel may be a fuel which burns "dirty". By this we mean that it produces carbon on combustion and this leads to carbon deposition on surfaces in the combustion system (hereinafter "coking") and/or has an exhaust which is visibly smoky.

As noted above the fuel may be a biofuel. R is commonly known that biofuels are inherently more oxidatively unstable as compared to petroleum based (or distilled) fuels. The inherent instability is attributed to the abundance of olefinic (unsaturated) materials available in the bio fuel as compared to petroleum based fuels. The exposure of a biofuel or a biofuel/distilled blend to air (oxygen) causes oxidation of the fuel, and leads to instability. The oxidation of the fuel results in the formation of alcohols, aldehydes, ketones, carboxylic acids and further reaction products of these functional groups, some of which may yield polymers.

Water also is an important component in facilitating degradation in biofuels. As microbial organisms produce and utilize enzymes (for example lipases) in their normal metabolic pathways, these organisms are able to digest biofuels, and any petroleum fuels present, resulting in detrimental changes in the bulk composition (for example sludge formation).

Moreover prolonged storage of biofuels and their blends at elevated temperature causes produces an increase in rates of other degradation processes (microbial, hydrolytic, oxidation) and results in enhanced storage instability.

The composition of petroleum fuel to which bio diesel is subsequently blended is also important factor in fuel instability. There is supporting data which indicates that the propensity of the fuel to form oxidation products is enhanced in certain fuel blends.

The invention is applicable, particularly but not exclusively, to blends of 70-98% wt/wt petroleum fuel(s) and 30-2% biofuel(s).

The factors described greatly increase the instability of bulk biofuel and biofuel/petroleum fuel blends, especially of bulk diesel and biodiesel/petroleum diesel blends. The degradation products of oxidation such as precipitates and gums can block engine nozzles or generate undesired deposits which can lead to subsequent engine damage. The instability oxidation of such fuels are of concern to fuel producers, engine manufacturers and informed fuel users.

In a further aspect the present invention provides a method for combustion of a fuel composition in a combustion system with an exhaust, comprising providing the fuel composition comprising:

(i) a metal compound selected from an iron compound, a manganese compound, a calcium compound, a cerium compound, and mixtures thereof;

(ii) an organic compound selected from a bicyclic monoterpene, substituted bicyclic monoterpene, adamantane, propylene carbonate and mixtures thereof;

(iii) a stabiliser; and (iv) a fuel;

and combusting the fuel composition.

In a further aspect the present invention provides the use, in a fuel composition burnt in a combustion system; of (i) a metal compound selected from an iron compound, a manganese compound, a calcium compound, a cerium compound, and mixtures thereof;

(ii) an organic compound selected from a bicyclic monoterpene, substituted bicyclic monoterpene, adamantane, propylene carbonate and mixtures thereof; and (iii) a stabiliser;

for one or more of the following purposes reducing or preventing coking on surfaces in the combustion system;

reducing or preventing visible smokiness of the exhaust gases;

rendering the fuel suitable for use in the combustion system (where without the additives it would not be suitable);

improving the stability of the fuel during storage and/or transportation;

improving the combustion efficiency of the fuel (for example reducing the amount of uncombusted hydrocarbons in the exhaust and/or reducing the amount of particulates in the exhaust and/or reducing the amount of carbon monoxide in the exhaust and/or minimising ignition delay);

improving the flow properties of the fuel.

It is found that some benefits of the invention are most prominent under low engine load conditions, for example when an engine is operating at no more than 50%, or no more than 25%, of its maximum deliverable power. Those represent preferred features of methods or uses of the invention.

It is found that benefits of the invention may alternatively or additionally be found at moderate or high engine load conditions, for example when an engine is operating at greater than 50%, or greater than 75% of its maximum deliverable power. Those represent preferred features of methods or uses of the invention.

In this specification when we refer to reducing carbon formation, deposition or carbon content we refer to elemental carbon, which may otherwise be called soot. In the case of exhaust gases carbon may cause them to be smoky.

When we refer in this specification to the combustion system we refer to any parts which are directly part of the burning equipment, such as fuel injectors and burners, and parts which are downstream of it, such as rotors, turbine blades, heat recovery equipment and exhaust ducting.

In one aspect, the task of the invention is to provide a fuel composition which provides components (i), (ii) and (iii) as herein defined, which may be used with benefit in fuels in general, but which offers particular advantage in heavy fuels and/or blended fuels, in maintaining stability, suppressing sooting of combustion surfaces and/or in exhaust gases, in improving combustion performance. In achieving the benefits of the invention fuels previously regarded as unusable in a given combustion context are rendered usable.

Further aspects of the invention are defined below, and in the appended claims.

BRIEF DESCRIPTION OF THE DRAWING

FIG. 1 is a graph of heat release plotted against crankshaft angle giving a measure of Ignition Delay.

DETAILED DESCRIPTION OF THE INVENTION

Metal Compound (i)

The metal compound (i) is selected from an iron compound, a manganese compound, a calcium compound, a cerium compound, and mixtures thereof.

It is important that a metal compound (i) for use in the invention is fuel soluble or dispersible and preferably fuel stable. The precise nature of the metal containing compounds is less important.

Manganese Compound

Preferably a manganese compound, when present, is selected from a manganese carbonyl compound, manganese (II) 2-ethylhexanoate, manganese naphthenate, and mixtures thereof.

The most desirable general type of manganese carbonyl compounds utilised in accordance with this invention comprise organomanganese polycarbonyl compounds. For best results, use should be made of a cyclopentadienyl manganese tricarbonyl compound of the type described in U.S. Pat. Nos. 2,828,417 and 3,127,351. Thus use can be made of such compounds as cyclopentadienyl manganese tricarbonyl, methylcyclopentadienyl manganese tricarbonyl, ethylcyclopentadienyl manganese tricarbonyl, dimethylcyclopentadienyl manganese tricarbonyl, trimethylcyclopentadienyl manganese tricarbonyl, propyicyclopentadienyl manganese tricarbonyl, isopropylcyclopentadienyl manganese tricarbonyl, butylcyclopentadienyl manganese tricarbonyl, pentylcyclopentadienyl manganese tricarbonyl, hexylcyclopentadienyl manganese tricarbonyl, ethylmethylcyclopentadienyl manganese tricarbonyl, dimethyloctylcyclopentadienyl manganese tricarbonyl, dodecylcyclopentadienyl manganese tricarbonyl, indenyl manganese tricarbonyl, and like compounds in which the cyclopentadienyl moiety contains up to about 18 carbon atoms.

In one aspect, the manganese compound is an organomanganese compound.

A preferred organomanganese compound is cyclopentadienyl manganese tricarbonyl. Particularly preferred for use in the practice of this invention is methylcyclopentadienyl manganese tricarbonyl.

Methods for the synthesis of cyclopentadienyl manganese tricarbonyls are well documented in the literature. See for example, in addition to U.S. Pat. Nos. 2,818,417 and 3,127,351 noted above, U.S. Pat. Nos. 2,868,816; 2,898,354; 2,960,514; and 2,987,529, among others.

Other organomanganese compounds which may be employed include the acyl manganese tricarbonyls such as methylacetyl cyclopentadienyl manganese tricarbonyl and benzoyl methyl cyclopentadienyl manganese tricarbonyl, described in U.S. Pat. No. 2,950,604; the aryl manganese pentacarbonyls such as phenyl manganese pentacarbonyl, described in U.S. Pat. No. 3,007,953; and the aromatic cyanomanganese dicarbonyls such as mesitylene cyanomanganese dicarbonyl, described in U.S. Pat. No. 3,042,693. Likewise, use can be made of cyclopentadienyl manganese dicarbonyl compounds of the formula $RMn(CO)_2L$, where R is a substituted or unsubstituted cyclopentadienyl group having 5 to 18 carbon atoms, and L is a ligand, such as an olefin, an amine, a phosphine, $SO_2$, tetrahydrofuran, or the like. Such compounds are referred to, for example in, Herberhold, M., *Metal π-Complexes*, Vol. II, Amsterdam, Elsevier, 1967 or Giordano, P. J. and Weighton, M. S., *Inorg. Chem.*, 1977, 16, 160. Manganese pentacarbonyl dimer (dimanganese decacarbonyl) can also be employed if desired.

Preferably the manganese compound is a manganese complex.

Preferably the manganese compound is selected from cyclopentadienyl manganese tricarbonyl and substituted cyclopentadienyl manganese tricarbonyl.

The manganese compound may be cyclopentadienyl manganese tricarbonyl and substituted cyclopentadienyl manganese tricarbonyl, wherein the substituents can be, for example, one or more $C_{1-5}$ alkyl groups, preferably $C_{1-2}$ alkyl groups. A combination of such manganese complexes may also be used.

Preferably the manganese compound is selected from cyclopentadienyl manganese tricarbonyl and substituted cyclopentadienyl manganese tricarbonyl.

Preferably the manganese compound is methylcyclopentadienyl manganese tricarbonyl (MMT).

Calcium Compound

Preferably a calcium compound, when present, is selected from calcium 2-ethylhexanoate, calcium napthenate, calcium sulphonates, calcium carboxylates (including calcium soaps including neutral calcium soaps and overbased calcium soaps); and mixtures thereof.

Preferably the calcium compound is calcium sulfonate.

Other suitable calcium compounds are disclosed in GB2248068 and GB2254610 and are discussed therein.

Cerium Compound

Preferably a cerium compound, when present, is selected from cerium (III) 2-ethylhexanoate, cerium sulphonates, cerium carboxylates (including cerium soaps including neutral cerium soaps and overbased cerium soaps); and mixtures thereof.

Iron Compound

There may be provided a single iron compound as metal compound (i), or a mixture of iron compounds.

Preferably the iron compound, when present, is an iron complex selected from bis-cyclopentadienyl iron; substituted bis-cyclopentadienyl iron; iron carboxylates (including iron soaps including overbased iron soaps, such as iron tallate and iron octoate); and mixtures thereof.

Preferably the iron compound is an iron complex selected from bis-cyclopentadienyl iron, substituted bis-cyclopentadienyl iron and mixtures thereof.

Preferably the iron compound is a substituted bis-cyclopentadienyl iron selected from adamantyl bis-cyclopentadienyl iron, bis(dicyclopentadienyl-iron) dicarbonyl and mixtures thereof. Bis(dicyclopentadienyl-iron) dicarbonyl is also known as cyclopentadienyl iron dicarbonyl dimer.

In one aspect, the iron compound is an iron complex selected from bis-cyclopentadienyl iron, adamantyl bis-cyclopentadienyl iron, bis(dicyclopentadienyl-iron)dicarbonyl, iron tallate and iron octoate; and mixtures thereof.

Other suitable substituted bis-cyclopentadienyl iron complexes are those wherein the substituents can be, for example, one or more $C_{1-30}$ alkyl groups, preferably $C_{1-20}$ alkyl groups, preferably $C_{1-10}$ alkyl groups, $C_{1-5}$ alkyl groups, preferably $C_{1-2}$ alkyl groups. A combination of such iron complexes may also be used.

Suitable alkyl-substituted-dicyclopentadienyl iron complexes are cyclopentadienyl-(methylcyclopentadienyl) iron, cyclopentadienyl(ethyl-cyclopentadienyl) iron, bis-(methylcyclopentadienyl) iron, bis-(ethylcyclopentadienyl) iron, bis-(1,2-dimethyl-cyclopentadienyl) iron, and bis-(1-methyl-3-ethylcyclo-pentadienyl) iron. These iron complexes can be prepared by the processes taught in U.S. Pat. No. 2,680,756, U.S. Pat. No. 2,804,468, GB-A-0733129 and GB-A-0763550. Another volatile iron complex is iron pentacarbonyl.

Suitable iron complexes are bis-cyclopentadienyl iron and bis-(methylcyclo-pentadienyl) iron.

The co-ordination chemistry relevant to the solubilisation of transition metals, including iron, in hydrocarbon solvents, e.g. diesel fuel, is well known to those skilled in the art (see e.g. WO-A-87/01720 and WO-A-92/20762).

Substituted bis-cyclopentadienyl complex of iron (substituted ferrocenes) for use in the invention include those in which substitution may be on either or both of the cyclopentadienyl groups. Suitable substituents include, for example, one or more $C_{1-5}$ alkyl groups, preferably $C_{1-2}$ alkyl groups.

Particularly suitable alkyl-substituted-dicyclopentadienyl iron complexes (substituted ferrocenes) include cyclopentadienyl(methylcyclopentadienyl) iron, bis-(methylcyclopentadienyl) iron, bis-(ethylcyclopentadienyl) iron, bis-(1,2-dimethylcyclopentadienyl) iron and 2,2-diethylferrocenylpropane.

Other suitable substituents that may be present on the cyclopentadienyl rings include cycloalkyl groups such as cyclopentyl, aryl groups such as tolylphenyl, and acetyl groups, such as present in diacetyl ferrocene. A particularly useful substituent is the hydroxyisopropyl group, resulting in ($\alpha$-hydroxyisopropyl)ferrocene. As disclosed in WO-A-94/09091, ($\alpha$-hydroxyisopropyl)ferrocene is a room temperature liquid.

Ferrocenes linked by a "bridge" may be used in the present invention. Suitable compounds are taught in WO 02/018398 and WO 03/020733. Thus, a suitable "bridge" linking ferrocenes may be a unsubstituted or substituted hydrocarbyl group. The term "unsubstituted or substituted hydrocarbyl group" as used herein means a group comprising at least C and H and which may, optionally, comprise one or more suitable substituents. In a preferred embodiment one carbon atom of the "bridge" hydrocarbyl group is attached to two ferrocene moieties, hence, bridging the ferrocenes. Further ferrocene moieties may be attached via further "bridge" hydrocarbyl groups. A typical unsubstituted or substituted hydrocarbyl group is an unsubstituted or substituted hydrocarbon group. Here the term "hydrocarbon" means any one of an alkylene group, an alkenylene group, an alkynylene group, which groups may be linear, branched or cyclic, or an aryl group. For example, the unsubstituted or substituted hydrocarbon group may be an alkylene, branched alkylene or cycloalkylene group. The term hydrocarbon also includes those groups but wherein they have been optionally substituted. If the hydrocarbon is a branched structure having substituent(s) thereon, then the substitution may be on either the hydrocarbon backbone or on the branch; alternatively the substitutions may be on the hydrocarbon backbone and on the branch. A preferred unsubstituted or substituted hydrocarbon group is an unsubstituted or substituted alkylene group having at least one carbon atom in the alkylene linkage. More preferably, the unsubstituted or substituted hydrocarbon group is an unsubstituted or substituted alkylene group having from 1 to 10 carbon atoms in the alkylene linkage, for example, having at least 2 carbon atoms in the alkylene linkage or having one carbon atom in the alkylene linkage. If the hydrocarbyl group comprises more than one C then those carbons need not necessarily be linked to each other. For example, at least two of the carbons may be linked via a suitable element or group. Thus, the hydrocarbyl group may contain hetero atoms. Suitable hetero atoms will be apparent to those skilled in the art and include, for instance, sulphur, nitrogen and oxygen, for example, oxygen.

Other organometallic complexes of iron may also be used in the invention, to the extent that these are fuel soluble and stable. Such complexes include, for example, iron pentacarbonyl, di-iron nonacarbonyl, (1,3-butadiene)-iron tricarbonyl, and (cyclopentadienyl)-iron dicarbonyl dimer. Salts such as di-tetralin iron tetraphenylborate ($Fe(C_{10}H_{12})_2(B(C_6H_5)_4)_2$) may also be employed.

A preferred iron complex is ferrocene (i.e. bis-cyclopentadienyl iron).

Instead of ferrocene, equivalent quantities of other organic iron compounds which are soluble in hydrocarbon mixtures can be used in respect of the iron content. This applies to all statements and descriptions which follow. Dicyclopentadienyl iron has proven to be particularly suitable. Ferrocene derivatives can be used at least in part instead of ferrocene. Ferrocene derivatives are compounds where, starting from a basic ferrocene molecule, further substituents are found on one or both of the cyclopentadienyl rings. Examples could be ethylferrocene, butylferrocene, acetylferrocene and 2,2-bis-ethylferrocenylpropane. Geminal bisferrocenylalkanes are also suitable, as described, for example, in DE 201 10 995 and DE 102 08 326.

As a result of a combination of their solubility, stability, high iron content and, above all, volatility, the substituted ferrocenes are preferred iron compounds for use in the invention. Ferrocene itself is an especially preferred iron compound on this basis. Ferrocene of suitable purity is sold in a range of useful forms as PLUTOcen® and as solutions, Satacen® both by Innospec Limited.

The iron compounds for use in the invention need not feature iron-carbon bonds in order to be fuel compatible and stable. Salts may be used; these may be neutral or overbased. Thus, for example, overbased soaps including iron stearate, iron oleate and iron naphthenate may be used. Methods for the preparation of metal soaps are described in The Kirk-Othmer Encyclopaedia of Chemical Technology, 4th Ed, Vol. 8:432-445, John Wiley & Sons, 1993. Suitable stoichiometric, or neutral, iron carboxylates for use in the invention include the so-called 'drier-iron' species, such as iron tris(2-ethylhexanoate) [19583-54-1].

Iron complexes not featuring metal-carbon bonds and not prepared as in the preceding reference may also be used in the invention provided these are adequately fuel compatible and stable. Examples include complexes with β-diketonates, such as tetramethylheptanedionate.

Iron complexes of the following chelating ligands are also suitable for use in the invention:

- aromatic Mannich bases such as those prepared by reaction of an amine with an aldehyde or ketone followed by nucleophilic attack on an active hydrogen containing compound, e.g. the product of the reaction of two equivalents of (tetrapropenyl)phenol, two of formaldehyde and one of ethylenediamine,
- hydroxyaromatic oximes, such as (polyisobutenyl)-salicylaldoxime. These may be prepared by reaction of (polyisobutenyl)phenol, formaldehyde and hydroxylamine;
- Schiff bases such as those prepared by condensation reactions between aldehydes or ketones (e.g. (tert-butyl)-salicylaldehyde) and amines (e.g. dodecylamine). A tetradentate ligand may be prepared using ethylenediamine (half equivalent) in place of dodecylamine;
- substituted phenols, such as 2-substituted-8-quinolinols, for example 2-dodecenyl-8-quinolinol or 2-N-dodecenylamino-methylphenol;
- substituted phenols, such as those wherein the substituent is $NR_2$ or SR in which R is a long chain (e.g. 20-30 C atoms) hydrocarbyl group. In the case of both α- and β-substituted phenols, the aromatic rings may beneficially be further substituted with hydrocarbyl groups, e.g. lower alkyl groups;
- carboxylic acid esters, in particular succinic acid esters such as those prepared by reaction of an anhydride (e.g. dodecenyl succinic anhydride) with a single equivalent of an alcohol (e.g. triethylene glycol);
- acylated amines. These may be prepared by a variety of methods well known to those skilled in the art. However, particularly useful chelates are those prepared by reaction of alkenyl substituted succinates, such as dodecenyl succinic anhydride, with an amine, such as N,N'-dimethyl ethylene diamine or methyl-2-methylamino-benzoate;
- amino-acids, for example those prepared by reaction of an amine, such as dodecylamine, with an α,β-unsaturated ester, such as methylmethacrylate. In cases where a primary amine is used, this may be subsequently acylated, such as with oleic acid or oleyl chloride;
- hydroxamic acids, such as that prepared from the reaction of hydroxylamine with oleic acid,
- linked phenols, such as those prepared from condensation of alkylated phenols with aldehydes preferably having 1-22, preferably 1-7, carbon atoms, for example formaldehyde;
- alkylated, substituted pyridines, such as 2-carboxy-4-dodecylpyridine;
- borated acylated amines. These may be prepared by reaction of a succinic acylating agent, such as poly(isobutylene)succinic acid, with an amine, such as tetraethylenepentamine. This procedure is then followed by boronation with a boron oxide, boron halide or boronic acid, amide or ester. Similar reactions with phosphorus acids result in the formation of phosphorus-containing acylated amines, also suitable for providing an oil-soluble iron chelate for use in the invention;
- pyrrole derivatives in which an alkylated pyrrole is substituted at the 2-position by OH, $NH_2$, NHR, $CO_2H$, SH or C(O)H. Particularly suitable pyrrole derivatives include 2-carboxy-t-butylpyrroles;
- sulphonic acids, such as those of the formula $R^1SO_3H$, where $R^1$ is a $C_8$ to $C_{60}$ hydrocarbyl group, e.g. dodecylbenzene sulphonic acid;
- organometallic complexes of iron, such as ferrocene, substituted ferrocenes, iron naphthenate, iron succinates, stoichiometric or over-based iron soaps (carboxylate or sulphonate), iron picrate, iron carboxylate and iron-diketonate complexes.

Suitable iron picrates for use in the invention include those described in U.S. Pat. No. 4,370,147 and U.S. Pat. No. 4,265,639.

Other iron-containing compounds for use in the invention include those of the formula M(R)x.nL wherein: M is an iron cation; R is the residue of an organic compound RH in which R is an organic group containing an active hydrogen atom H replaceable by the metal M and attached to an O, S, P, N or C atom in the group R; x is 2 or 3; n is 0 or a positive integer indicating the number of donor ligand molecules forming a dative bond with the metal cation; and L is a species capable of acting as a Lewis base.

Preferred Metal Compound (i)

Preferably, the metal compound (i) is selected from one or more iron compounds, methylcyclopentadienyl manganese tricarbonyl, manganese(II) 2-ethylhexanoate, manganese naphthenate, calcium 2-ethylhexanoate, calcium napthenate, calcium sulfonate, cerium(III) 2-ethylhexanoate, cerium sulfonate, and mixtures thereof.

A preferred metal compound (i) is an iron compound, especially ferrocene.

Organic Compound (ii)

The organic compound (ii) is selected from a bicyclic monoterpene, substituted bicyclic monoterpene, adamantane, propylene carbonate and mixtures thereof.

Preferably, the organic compound (ii) is selected from a bicyclic monoterpene, substituted bicyclic monoterpene and mixtures thereof.

Suitable substituted bicyclic monoterpenes are those wherein the substituents can be, for example, one or more of aldehyde, ketone, alcohol, acetate and ether functional groups.

Preferably, the organic compound (ii) is a bicyclic monoterpene or substituted bicyclic monoterpene selected from camphor, camphene, isobornyl acetate, dipropyleneglycol-isobornyl ether and mixtures thereof.

In one aspect, the organic compound (ii) is selected from camphor, camphene, isobornyl acetate, dipropyleneglycol-isobornyl ether, adamantane, propylene carbonate and mixtures thereof.

Preferably, the organic compound (ii) is camphor. Camphor has the systematic name 1,7,7-trimethylbicyclo[2.2.1]heptan-2-one. Camphor has the following structure:

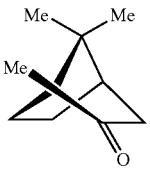

Stabiliser (iii)

The stabiliser is a compound which acts to maintain the uniformity of the fuel, and hence its mobility.

Asphaltene Dispersants as Stabiliser (iii)

Compounds suitable for use herein as stabiliser (iii) include asphaltene dispersants.

Asphaltenes may cause loss of uniformity and mobility, and ultimately stability, of a fuel, by promoting separation or sedimentation within the fuel. An asphaltene dispersant herein acts to disperse asphaltenes in a fuel.

Ultimately the aim is to prevent asphaltenes from causing flow problems, or separation, or sedimentation, from coking surfaces or forming carbon aggregates which are visible as "smoke" in exhaust gases. Asphaltene dispersants are commonly believed to form a steric layer around the asphaltenes, which tend to be aromatic and are commonly resins. Asphaltene dispersants appear to inhibit the formation of asphaltene-rich sludge. It is believed that when fuel containing well-dispersed asphaltenes is burnt, the asphaltenes are more fully combusted, ultimately to carbon dioxide, rather than soot and carbon monoxide. Components (i) and (ii) assist in achieving excellent, clean combustion. However whilst we have a theory to explain the benefits of the invention, we are not bound by theory. The invention relies on the finding that compounds of formula (i), (ii) and (iii) work in combination to provide the benefits referred to above, in particular the valuable benefit that dirtier fuels can be used in situations where lighter fuels have previously been thought necessary.

Suitable asphaltene dispersants for use in the present invention include alkoxylated fatty amines or derivatives thereof; alkoxylated polyamines; alkane sulphonic acids; aryl sulphonic acids; sarcosinates; ether carboxylic acids; phosphoric acid esters; carboxylic acids and derivatives thereof; alkylphenol-aldehyde resins; hydrophilic-lipophilic vinylic polymers; alkyl substituted phenol polyethylene polyamine formaldehyde resins; alkyl aryl compounds; alkoxylated amines and alcohols; imines; amides; zwitterionic compounds; fatty acid esters; lecithin and derivatives thereof; and derivatives of succinic anhydride and succinamide.

Preferred asphaltene dispersants for use in the present invention are molecules comprising alkyl groups, preferably alkyl groups having at least 12 carbon atoms and polar functional groups selected from, for example, sulphonic acid groups, phosphonic acid groups, carboxylic acid groups, amines, amides, imides, alcohols and esters. Compounds including aromatic moieties are also suitable. Regions of the molecule may, for example, be linked by a polyalkoxylene unit, carbonate groups, imine or amide groups.

Suitable compounds are polymeric or oligomeric compounds. Most suitable are polymeric or oligomeric compounds including a hydrophobic functionality and a hydrophilic functionality.

Suitable alkoxylated fatty amines include those of formula (i):

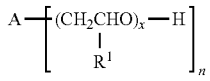

(i)

where n is an integer from 1 to 4, wherein when n is 1, A has structure (a); when n is 2, A has structure (b); when n is 3, A has structure (c) and when n is 4, A has structure (d):

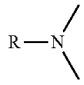

(a)

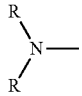

(b)

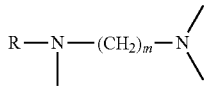

(c)

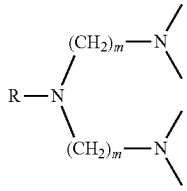

(d)

and wherein R is a $C_6$ to $C_{22}$ alkyl, preferably a $C_6$ to $C_{18}$ alkyl; m is 2, 3 or 4, preferably 2 or 3; x is a number from 5 to 120, preferably from 10 to 80; and $R^1$ may be H, $CH_3$ or both. When both, the oxyalkylene moieties may be arranged randomly or in blocks.

Suitable sulphonic acid derivatives for use as asphaltene dispersants include alkyl sulphonic acids, aryl sulphonic acids, alkyl aryl sulphonic acids, and derivatives thereof, for example those of formula (ii):

$$RSO_3X \quad \text{(ii)}$$

wherein X is hydrogen or an alkali metal ion; and R is an optionally substituted, linear or branched, alkyl group having 2 to 40 carbon atoms, preferably 5 to 30 carbon atoms; or an optionally substituted aryl group having up to 30 carbon atoms. Preferred aryl groups are those based on napthalene or especially, benzene.

In preferred embodiments R is an alkyl aryl suphonic acid in which R is $R^1Ar^1$ wherein $R^1$ is an alkyl group having 12 to 32, especially 12 to 24 carbon atoms and $Ar^1$ is a disubstituted aryl moiety, most preferably $C_6H_4$.

Also preferred are secondary alkane sulphonic acids in which R has 8 to 22, preferably 11 to 18 carbon atoms.

Preferred sarcosinates for use as asphaltene dispersants in the present invention include those of formula (iii):

(iii)

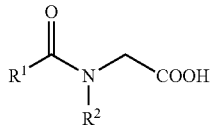

Wherein $R^1$ and $R^2$ are independently selected from optionally substituted alkyl groups having 1 to 30 carbon atoms. Preferably $R^1$ is a $C_7$ to $C_{21}$ alkyl or alkenyl and $R^2$ is H, methyl, butyl, isobutyl or a $C_{11}$ to $C_{22}$ alkyl.

Suitable ether carboxylic acids for use as asphaltene dispersants in the present invention include compounds in which an optionally substituted hydrocarbyl moiety is linked to a carboxylic acid residue by one or more alkoxy groups. Examples of preferred ether carboxylic compounds include compounds of formula (iv):

$$RO(CH_2CHR^1O)_x(CH_2CHR^2O)_yCH_2COOH \quad (iv)$$

wherein R is $C_2$ to $C_{30}$, preferably C6 to C22, preferably C9 to C18 alkyl or alkenyl, or C2 to C30, preferably C6 to C20 alkylaryl; R1 and R2 are independently H or CH3, preferably H; and x and y are independently 0 to 30, preferably 0 to 20. Preferably the sum of a and y is between 1 and 20, preferably between 1.5 and 8.

Phosphoric acid esters suitable for use in the present invention include monesters, diesters and triesters prepared from the reaction of phosphoric acid with fatty alcohols, alkoxylated fatty alcohols and alkoxylated alkylaryl alcohols. Preferred phosphoric acid esters include the monoesters and diesters of formula (v):

(v)

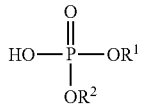

wherein $R^1$ is selected from H, a $C_1$ to $C_{30}$, preferably a $C_1$ to $C_{22}$ alkyl group, a $C_2$ to $C_{30}$, preferably $C_2$ to $C_{22}$ alkenyl group, a $C_6$ to $C_{30}$, preferably $C_6$ to $C_{18}$ alkylaryl group or $(CH_2CHR^3O)_nR^4$, where $R^3$ is H or $CH_3$, preferably H, $R^4$ is H, a $C_1$ to $C_{30}$, preferably a $C_1$ to $C_{22}$ alkyl group, a $C_2$ to $C_{30}$, preferably $C_2$ to $C_{22}$ alkenyl group, or a $C_6$ to $C_{30}$, preferably $C_6$ to $C_{18}$ alkyl alkylaryl group, and n is an integer from 1 to 30, preferably 1 to 20, more preferably from 1 to 10; and $R^2$ is selected from a $C_1$ to $C_{30}$, preferably a $C_1$ to $C_{22}$ alkyl group, a $C_2$ to $C_{30}$, preferably $C_2$ to $C_{22}$ alkenyl group, a $C_6$ to $C_{30}$, preferably $C_6$ to $C_{18}$ alkylaryl group or $(CH_2CHR^5O)_m R^6$, where $R^5$ is H or $CH_3$, preferably H, $R^6$ is H, a $C_1$ to $C_{30}$, preferably a $C_1$ to $C_{22}$ alkyl group, a $C_2$ to $C_{30}$, preferably $C_2$ to $C_{22}$ alkenyl group, or a $C_6$ to $C_{30}$, preferably $C_6$ to $C_{18}$ alkyl alkylaryl group, and m is an integer from 1 to 30, preferably 1 to 20, more preferably from 1 to 10. Preferred alkylaryl substituents when present are those based on benzene or naphthalene and alkyl and alkenyl substituents may be branched or linear and preferably have 10 to 20, especially 12 to 18 carbon atoms.

Suitable carboxylic acids for use as asphaltene dispersants are those having more than 4 carbon atoms, especially those having 8 to 22 and in particular 12 to 18 carbon atoms.

Suitable hydrophilic-lipophilic vinylic polymers for use as asphaltene dispersants are those of formula (vi);

(vi)

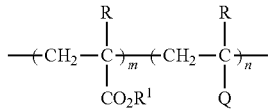

wherein each R is independently selected from H and $CH_3$; each $R^1$ is an alkyl, alkenyl, aryl, alkylaryl or arylalkyl group having 2 to 30, preferably 4 to 22 carbon atoms; and each Q is selected from $CO_2M$ and $CONHR^2$ wherein M may be H, a group I or group II metal ion, ammonium or amine cation, hydroxyl ethyl, hydroxyl propyl or $—(CH_2CHRO)_xH$ and each $R^2$ is $—(CH_2CHRO)_xH$ or $—(CH_2)_{1-3}COOM$ wherein x is 1 to 30, preferably 1 to 20; and n is an integer selected such that the polymer has a weight average molecular weight of between 5000 and 250000.

Suitable alkyl substituted phenol polyethylene polyamine formaldehyde resins for use as asphaltene dispersants include those prepared by the base catalyzed reaction of a monosubstituted alkylphenol having an alkyl substituent containing from about 4 to 24 carbon atoms, which alkyl substituent may be a linear or branched alkyl group and a polyethylene polyamine represented by the formula $H_2N(CH_2CH_2NH)_nH$ where n is an integer of from 1 to 5; and formaldehyde; in a mole ratio of alkylphenol to polyethylenepolyamine of from 5:1 to 3:1, and a mole ratio of alkylphenol to formaldehyde of from about 2:1 to 1:2, said resin having a weight average molecular weight of from about 1,000 to about 20,000.

Suitable substituted aromatic compounds for use as asphaltene dispersants include those of formula (vii):

$$X—(R)_n \quad (vii)$$

wherein n is from 1 to the valency of X, X is an optionally substituted carbocyclic ring, preferably derived from benzene, naphthalene or anthracene and R is and aliphatic chain preferably and alkyl group having 10 to 25, preferably 12 to 20 carbon atoms.

Suitable asphaltene dispersants may include condensation products of fatty acids having from 12 to 24 carbon atoms and polyamines of the general formula $H_2N—[(CH_2)_n—NH]_m—R^1$ in which $R^1$ is hydrogen, a methyl, ethyl, hydroxyethyl or a $—(CH_2)_n—NH—R^2$ group, $R^2$ is hydrogen, a methyl, ethyl or hydroxyethyl group, and n is a number between 1 and 4, and m stands for numbers from 1 to 6.

Suitable asphaltene dispersants may include alkoxylated fatty amines and alkoxylated fatty alcohols. Preferred examples of these include alkoxylated (especially ethoxylated) fatty alcohols having from 8 to 22 carbon atoms and from 10 to 60 mol of alkoxide per mole of fatty alcohol and ethoxylated alkylamines having alkyl radicals of from 12 to 22 carbon atoms and from 10 to 30 mol of ethylene oxide per mole of alkylamine.

Suitable asphaltene dispersants may include imine, thiocarbonyl, or carbonyl containing compounds of formula (viiii) which have at least 8, preferably at least 10 carbon atoms:

(viii)

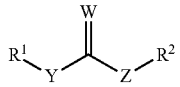

wherein V is $C_1$-$C_3$ difunctional alkyl, O, S, $NR^3$ or is absent; Z is hydrogen, O, S, $NR^4$ or is absent; W is O, S, or $NR^5$; $R^1$, $R^2$, $R^3$, $R^4$ and $R^5$ independently are hydrogen or organic functional groups; and at least one of Y, $R^1$, $R^2$, $R^3$, $R^4$ and $R^5$ is substituted by at least one polar group two to ten chemical bonds from the carbonyl, thiocarbonyl or imine carbon. Preferred polar groups are hydroxyl and hydroxylamino. Preferred organic functional groups are optionally substituted alkyl, heteroalkyl, aryl, aralkyl, heterocyclic or heterocyclic-alkyl groups. In a preferred embodiment, at least one of the organic functional groups is a $C_2$-$C_{22}$ alkyl or heteroalkyl group, more preferably a $C_7$-$C_{22}$ alkyl or heteroalkyl group, more preferably a $C_9$-$C_{22}$ alkyl or heteroalkyl group, and most preferably, a $C_{15}$-$C_{22}$ alkyl group. Preferably, the alkyl or heteroalkyl groups are unsubstituted.

Suitable asphaltene dispersants may include the reaction product of an imine and an organic acid. Examples of preferred such asphaltene dispersants are salts of carboxylic, phosphonic or sulfonic acid, especially one having only a single acidic group. Preferably the salt has a polar group located two to ten chemical bonds from either a carbonyl carbon of a carboxylate group, a phosphorus atom of a phosphonate group or a sulfur atom of a sulfonate group; or a nitrogen atom of a protonated imine group. The polar group is preferably selected from hydroxy, oxime, nitro, ester, amide or alkyl amide.

Suitable asphaltene dispersants may include the reaction product of an amine and an organic acid. Examples of preferred asphaltene dispersants are salts a carboxylic, phosphonic or sulfonic acid. Preferably the salt has a polar group located two to eight chemical bonds from either a carbonyl carbon of a carboxylate group, a phosphorus atom of a phosphonate group or a sulfur atom of a sulfonate group; or a nitrogen atom of a protonated amine group. The polar group is preferably selected from hydroxyl and oxime.

Suitable asphaltene dispersants may include compounds of formulas (ix) or a zwitterionic salt thereof:

(ix)

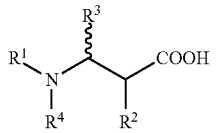

wherein $R^1$ is $C_{10}$-$C_{22}$ alkyl or aralkyl; $R^2$ and $R^3$ independently are hydrogen or $C_1$-$C_4$ alkyl; $R^4$ is hydrogen, $C_1$-$C_{22}$ alkyl, $C_7$-$C_{22}$ arylalkyl, or —$CH(R^5)CH(R^6)COOH$, wherein $R^5$ and $R^6$ independently are hydrogen or $C_1$-$C_4$ alkyl.

Alkylene oxide phosphite asphaltenates (or phosphoalkoxylated asphaltenes) may also be used as asphaltene dispersants, as described in U.S. Pat. No. 5,207,891.

Suitable asphaltene dispersants may include a polymer comprising structural units derived from monomers which are at least one of (A) at least one ethylenically unsaturated alcohol, carboxylic acid or ester, (B) an ethylenically unsaturated carboxylic ester with a polar group in the ester, and (C) an ethylenically unsaturated carboxylic amide, wherein at least one of said structural units contains at least one pendant ring group. Alternatively, the pendant ring group may be introduced into the polymer by transesterification. Alkyl methacrylates and alkylphenyl methacrylates are suitable, for example $C_6$-$C_{22}$ alkyl methacrylates and $C_6$-$C_{22}$ alkylphenyl methacrylates. Two examples of the structural unit are p-nonylphenyl methacrylate and p-dodecylphenyl methacrylate.

Suitable asphaltene dispersants may include polymers comprising di-(C1-4alkyl)amino (C1-4alkyl)(meth)acrylate units. By the notation (meth)acrylate here and elsewhere in this specification we include methacrylate and acrylate.

Suitable asphaltene dispersants may include copolymers of C12-24 alkyl(meth)acrylate and di-(C1-4alkyl)amino (C1-4alkyl)(meth)acrylate.

Suitable asphaltene dispersants may include esters of a $C_6$-$C_{33}$ fatty acid, preferably of a $C_{10}$-$C_{22}$ fatty acid. The fatty acid may be saturated (for example lauric, stearic) or unsaturated (for example oleic).

Suitable esters may comprise compounds formed by the reaction of a first compound having 1 to 4, preferably 1 to 3 acid functional groups and a second compound having 1 to 8, preferably 1 to 6, more preferably 1 to 3 hydroxyl groups. Depending on the compounds selected and their relative amounts the ester may therefore comprise excess hydroxyl groups or excess acidic groups, or an excess of neither. The first compound preferably contains 4 to 36 carbon atoms, preferably 8 to 24 carbon atoms. The second compound preferably contains 1 to 8 carbon atoms, preferably 1 to 5 carbon atoms.

The esters may, for example, include a monooleate, dioleate, monostearate, distearate, monolaurate or dilaurate; or, in the case of a sorbitan compound, for example, a trioleate or tristearate, for example. Especially preferred are sorbitan esters, for example sorbitan monoesters such as sorbitan monooleate, and sorbitol triesters such as sorbitan trioleate. The esters may be alkoxylated, for example ethoxylated.

Suitable asphaltene dispersants may include polyethylene glycol fatty acid esters. Examples include esters formed by the reaction of fatty acids having 6 to 30, preferably 8 to 24 carbon atoms with alcohols containing 1 to 20 ethylene oxide units.

Suitable asphaltene dispersants include lecithin and lecithin derivatives, for example soya lecithin.

Suitable asphaltene dispersants include succinimides and succinic anhydride derivatives of general formula shown in (x):

(x)

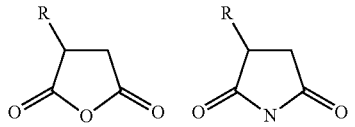

wherein R is an optionally substituted alkyl group, preferably having 1 to 50 carbon atoms. Most preferably R is a polyisobutyl chain.

Suitable asphaltene dispersants include poly(alkylene oxides), notably polyethylene oxide, polypropylene oxide and poly(ethylene oxide/propylene oxide), preferably ethylene oxide/propylene oxide block copolymers.

Suitable asphaltene dispersants include phenolic resins. Preferred phenolic resins include compounds of formula (xi):

(xi)

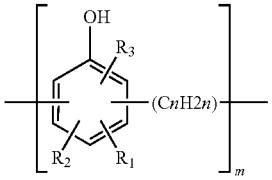

wherein m is at least 1; wherein n is at least 1; wherein the or each $R^1$, $R^2$ and $R^3$ are independently selected from hydrogen, alkyl groups, aromatic groups and heterocycles, or may be OH, hydrocarbyl groups, oxyhydrocarbyl groups, —CN, —$NO_2$, —$SO_3H$, —$SO_2H$, —COOH, —$COOR^4$, —$NH_2$, —$NHR^5$, —$SO_2NH_2$, —$SO_2$, —$NHR^6$, $CONH_2$, $CONHR^7$, SH and halogens; wherein each of $R^4$, $R^5$, $R^6$ and $R^7$ is independently selected from hydrocarbyl groups. The term "hydrocarbyl" as used herein means any one of an alkyl group, an alkenyl group, an alkenyl group, an acyl group, which groups may be linear, branched or cyclic, or an aryl group. The term hydrocarbyl also includes those groups but wherein they have been optionally substituted. If the hydrocarbyl is a branched structure having substituent(s) thereon, then the substitution may be on either the hydrocarbyl backbone or on the branch; alternatively the substitutions may be on the hydrocarbyl backbone and on the branch.

In one preferred aspect m is greater than 1. In one preferred aspect, m is 1 to 50, such as 1 to 40, 5 to 30, or 10 to 20. In a preferred aspect, m is 11 to 15.

n may be any suitable integer. For example n may be from 1 to 10 such as 1 to 8, 1 to 5 or 1, 2 or 3. Preferably n is 1.

Where n is greater than 1, the "linker" group $C_nH_{2n}$ may be branched.

Preferably $R^1$ is not hydrogen.

Preferably $R^1$ is an alkyl group having at least 1 carbon atom, preferably at least 5, or 6, or 7, or 8, or 9 carbons atoms.

Preferably $R^1$ is an alkyl group having up to 80 carbon atoms, preferably up to 50, or 32, or 30, or 28, or 26, or 24 carbon atoms.

In certain preferred embodiments $R^1$ is a preferably a $C_5$-$C_{20}$ alkyl group, preferably a $C_5$-$C_{15}$ alkyl group, preferably a $C_6$-$C_{12}$ alkyl group, preferably a $C_7$-$C_{11}$ alkyl group, preferably a $C_8$-$C_{10}$ alkyl group, more preferably a $C_9$ alkyl group.

In certain preferred embodiments $R^1$ is a preferably a $C_{12}$-$C_{32}$ alkyl group, preferably a $C_{16}$-$C_{28}$ alkyl group, preferably a $C_{20}$-$C_{24}$ alkyl group.

In one aspect, $R^1$ is a branched alkyl group, preferably a $C_{3-6}$ branched alkyl group, for example t-butyl.

In one aspect, $R^1$ is a straight chain alkyl group.

In one preferred aspect $R^1$ is para substituted relative to the OH group.

In one preferred aspect the $C_nH_{2n}$ group is ortho substituted relative to the OH groups.

Preferably $R^1$ is para substituted relative to the OH group and the $C_nH_{2n}$ group(s) are ortho substituted relative to the OH group.

Preferably $R^2$ is hydrogen. Preferably $R^3$ is hydrogen. Preferably $R^2$ and $R^3$ are both hydrogen. In embodiments in which $R^2$ is not a hydrogen, $R^2$ is preferably an optionally substituted linear or branched alkyl group. In embodiments in which $R^3$ is not hydrogen, $R^3$ is preferably an optionally substituted linear or branched alkyl group.

The term "hydrocarbyl" as used herein means any one of an alkyl group, an alkenyl group, an alkenyl group, an acyl group, which groups may be linear, branched or cyclic, or an aryl group. The term hydrocarbyl also includes those groups but wherein they have been optionally substituted. If the hydrocarbyl is a branched structure having substituent(s) thereon, then the substitution may be on either the hydrocarbyl backbone or on the branch; alternatively the substitutions may be on the hydrocarbyl backbone and on the branch.

In such embodiments, preferably $R^2$ and/or $R^3$ is an alkyl group independently selected from a $C_1$-$C_{50}$ group, preferably a $C_1$-$C_{40}$ group, preferably a $C_1$-$C_{30}$ group, preferably a $C_1$-$C_{25}$ group, preferably a $C_1$-$C_{15}$ group.

A typical example of $R^2$ or $R^3$ is a tertiary alkyl group, such as a tertiary butyl group.

In a preferred aspect each of $R^2$ and $R^3$ is present as a substituent (rather than hydrogen), such that ring A is fully substituted.

In a preferred aspect the phenolic resin is a substituted phenolic resin. More preferably the phenolic resin is the reaction product of substituted phenol and an aldehyde.

More preferably the phenolic resin is the reaction product of substituted phenol and an aldehyde having 1-22, preferably 1-7 carbon atoms, for example formaldehyde.

In a preferred aspect the phenolic resin is a $C_9$-$C_{24}$ phenolic resin.

More preferably the phenol resin is the reaction product of $C_9$-$C_{24}$ phenol and formaldehyde, or of t-butyl phenol and an aldehyde having 1-22, preferably 1-7, carbon atoms, for example formaldehyde.

Alkoxylated phenolic resins (ethoxylated and/or propoxylated) are available. Their use is not excluded, but it is not preferred, as excellent results have been obtained using non-alkoxylated phenolic resins.

Fuel Antioxidants as Stabiliser (iii)

Fuel instability may be promoted by oxidation of components of, or within, the fuel. This is a significant issue in the context of biofuels.

Compounds suitable for use herein as stabiliser (iii) include antioxidants used in fuel environments.

Antioxidants suitable for use as stabilisers in the present invention include phenolic antioxidants, sulphurized phenolic antioxidants and aromatic amine antioxidants.

Preferred phenolic antioxidants are hydrocarbon soluble phenolic antioxidants and especially those in which at least one ortho position of the phenol is blocked. Suitable antioxidants include those of formula:

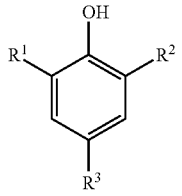

where $R^1$, $R^2$, and $R^3$ are the same or different and are each alkyl, aryl, alkylaryl, arylalkyl, hydroxyalkyl, hydroxyaryl, hydroxyalkylaryl, hydroxyarylalkyl groups, or heteroatomic alkyl, aryl, alkylaryl, arylalkyl, hydroxyalkyl, hydroxyaryl, hydroxyalkylaryl, hydroxyarylalkyl groups containing nitrogen, sulfur, or oxygen and where at least one of $R^1$ and $R^2$ provide stearic hindrance. $R^1$ and/or $R^2$ are preferably isobutyl or tertiary butyl groups. The hindered phenol is preferably either 2,6-di-tert-butyl-4-methylphenol or 6-tert-butyl-2,4-dimethylphenol. Further preferred examples include 2-tert-butylphenol, 2-ethyl-6-methylphenol, 2,6-di-tert-butyl-phenol, 2,6-di-tert-butyl-4-methylphenol, 2,2'-methylene-bis-4, 6di-tert-butyl-phenol, 4,4'-methylene-bis(2,6-di-tert-butyl-phenol) and 2,2'-propylidene-bis(6-tert-butyl-4-methylphenol). Mixtures of such antioxidants can also be used.

Also useful as stabilisers are sulfides having a general formula $R^4$—S—$R^5$ and phosphine compounds having a general formula $PR^6R^7R^8$ where $R^4$, $R^5$, $R^6$, $R^7$, and $R^8$ are the same or different and are each alkyl, aryl, alkylaryl, arylalkyl, hydroxyalkyl, hydroxyaryl, hydroxyalkylaryl, hydroxyarylalkyl groups, or heteroatomic alkyl, aryl, alkylaryl, arylalkyl, hydroxyalkyl, hydroxyaryl, hydroxyalkylaryl, hydroxyarylalkyl groups containing nitrogen, sulfur, or oxygen.

Additionally the compounds mentioned below as biofuel instability inhibitors may be useful as fuel antioxidants.

Cold Flow Improvers as Stabiliser (iii)

Compounds suitable for use herein as stabiliser (iii) include cold flow improvers.

A cold flow improver may act in a fuel, especially a fuel which may freeze under ambient conditions (for example diesel), to maintain flow conditions under conditions which otherwise would cause freezing occur, and the fuel to become unusable.

Cold flow improvers useful as stabilisers in the present invention include copolymers of alkenes and unsaturated esters, alkylmethacrylate polymers, polyoxyalkylene esters, ethers, ester/ethers and mixtures thereof.

Examples of copolymers of alkenes and unsaturated esters include ethylene-unsaturated ester copolymers. Favoured are those having, in addition to units derived from ethylene, units of the formula $$—CR^1R^2—CHR^3—$$

wherein $R^1$ represents hydrogen or methyl; $R^2$ represents $COOR^4$, wherein $R^4$ represents an alkyl group having from 1 to 9 carbon atoms which is straight chain or, if it contains 3 or more carbon atoms, branched, or $R^2$ represents $OOCR^5$, wherein $R^5$ represents $R^4$ or H; and $R^3$ represents H or $COOR^4$. These may comprise a copolymer of ethylene with an ethylenically unsaturated ester, or derivatives thereof. An example is a copolymer of ethylene with an ester of a saturated alcohol and an unsaturated carboxylic acid, but preferably the ester is one of an unsaturated alcohol with a saturated carboxylic acid. An ethylene-vinyl ester copolymer is advantageous; an ethylene-vinyl acetate, ethylene-vinyl propionate, ethylene-vinyl hexanoate, or ethylene-vinyl octanoate copolymer is preferred. Preferably, the copolymer contains from 5 to 40 wt % of the vinyl ester, more preferably from 10 to 35 wt % vinyl ester. A mixture of two or more such copolymers, for example as described in U.S. Pat. No. 3,961,916, may be used. The number average molecular weight of the copolymer, as measured by vapour phase osmometry, is advantageously 1,000 to 10,000, preferably 1,000 to 5,000. If desired, the copolymer may contain units derived from additional comonomers, e.g. a terpolymer, tetrapolymer or a higher polymer, for example where the additional comonomer is isobutylene or disobutylene. The copolymers may be made by direct polymerization of comonomers, or by transesterification, or by hydrolysis and re-esterification, of an ethylene unsaturated ester copolymer to give a different ethylene unsaturated ester copolymer. For example, ethylene-vinyl hexanoate and ethylene-vinyl octanoate copolymers may be made in this way, e.g., from an ethylene-vinyl acetate copolymer.

Examples of alkyl(meth)acrylate polymers useful as cold flow improvers include copolymers consisting of 10 to 95 mol % of one or more alkyl acrylates or alkyl methacrylates with $C_1$- to $C_{26}$-alkyl chains and of 5 to 90 mol % of one or more ethylenically unsaturated dicarboxylic acids or their anhydrides, the copolymer having been extensively reacted with one or more primary or secondary amines to give the monoamide or amide/ammonium salt of the dicarboxylic acid. The copolymers preferably contain from 10 to 95, preferably 40 to 95, and most preferably 60 to 90, mol % of the one or more alkyl(meth)acrylates and from 5 to 90, preferably 5 to 60, and most preferably 10 to 40, mol % of the one or more ethylenically unsaturated dicarboxylic acids or anhydrides. The alkyl groups of the alkyl(meth)acrylates are said to contain from 1 to 26, preferably 4 to 22, and most preferably 8 to 18, carbon atoms. The alkyl groups are preferably straight-chained and unbranched. However, up to 20% w of cyclic and/or branched alkyl components may be present. Examples of particularly preferred alkyl(meth)acrylates are listed as n-octyl(meth) acrylate, n-decyl(meth)acrylate, n-dodecyl(meth)acrylate, n-tetradecyl(meth)acrylate, n-hexadecyl(meth)acrylate and n-octadecyl(meth)acrylate and mixtures of these. Examples of ethylenically unsaturated dicarboxylic acids are said to be maleic acid, tetrahydrophthalic acid, citraconic acid and itaconic acid and their anhydrides as well as fumaric acid. Maleic anhydride is preferred.

Examples of polyoxyalkylene esters, ethers, ester/ethers or mixtures thereof useful as cold flow improvers include those containing at least two $C_{10}$ to $C_{30}$ linear saturated alkyl groups and a polyoxyalkylene glycol of molecular weight 200 to 2,000, the alkylene group of said polyoxyalkylene glycol containing from 1 to 4 carbon atoms.

Wax Anti-Settling Agents as Stabiliser (iii)

Compounds suitable for use herein as stabiliser (iii) include wax anti-settling agents.

A wax anti-settling agent may act in a fuel, especially a fuel which may freeze under ambient conditions (for example diesel), to maintain flow conditions under conditions which otherwise would cause freezing to occur, and the fuel to become unusable.

Wax anti-settling agents useful as stabilisers in the present invention include certain polyimide and maleic anhydride olefin copolymers.

Suitable maleic anhydride olefin copolymer additives may be prepared by the reaction of maleic anhydride with an α-olefin. Generally such copolymer additives preferably contain substantially equimolar amounts of maleic anhydride and α-olefin. The operative starting α-olefin is a mixture of individual α-olefins having a range of carbon numbers. The starting α-olefin composition used to prepare the maleic anhydride olefin copolymer additive of the invention has at least a minimum α-olefin concentration by weight with a carbon number within the range from about $C_{20}$ to about $C_{40}$. The additive generally contains blends of α-olefins having carbon numbers within this range. The operative starting α-olefin may have a minor component portion which is outside the above carbon number range. The maleic anhydride α-olefin copolymers have a number average molecular weight in the range of about 1,000 to about 5,000 as measured by vapor pressure osmometry. Also suitable are wax anti-settling additives comprising an imide produced by the reaction of an alkyl amine, maleic anhydride and α-olefin. Generally the imide is produced from substantially equimolar amounts of maleic anhydride and α-olefin. The operative α-olefin is similar in composition to that described above for the maleic anhydride olefin copolymer additive. Particularly advantageous properties are obtained when the alkyl amine is tallow amine. The imide preferably has a number average molecular weight in the range of about 1,000 to about 8,000 as measured by vapor pressure osmometry.

Suitable stabilisers include additives of formula:

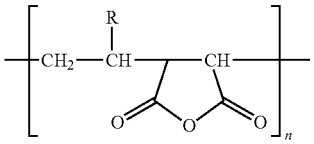

wherein R has at least 60% by weight of a hydrocarbon substituent from about 20 to about 40 carbons, and n is from about 2 to about 8. Preferably R has at least 70% by weight of a hydrocarbon substituent from about 20 to about 40 carbons, and most preferably R has at least 80% by weight of a hydrocarbon substituent from about 20 to about 40 carbons. In a preferred embodiment R has at least 60% by weight of a hydrocarbon substituent with a carbon number range from 22 to 38 carbons, more preferably at least 70% by weight, and most preferably at least 80% by weight. The resulting maleic anhydride α-olefin copolymer has a number average molecular weight in the range of about 1,000 to about 5,000, as determined by vapor pressure osmometry.

Also useful are stabilisers of formula:

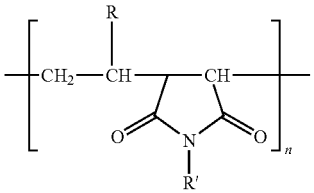

wherein R has at least 60% by weight of a hydrocarbon substituent from about 20 to about 40 carbons, R' has at least 80% by weight of a hydrocarbon substituent from 16 to 18 carbons, and n is from about 1 to about 8. Preferably R has at least 70% by weight of a hydrocarbon substituent from about 20 to about 40 carbons, and most preferably R has at least 80% by weight of a hydrocarbon substituent from about 20 to about 40 carbons. In a preferred embodiment R has at least 60% by weight of a hydrocarbon substituent with a carbon number range from 22 to 38 carbons, more preferably at least 70% by weight, and most preferably at least 80% by weight. Typically, R' has at least 90% by weight of a hydrocarbon substituent from 16 to 18 carbons. The above additive, described as an imide, has a number average molecular weight as determined by vapor pressure osmometry in the range of about 1,000 to about 8,000.

Further compounds alleged to be useful as wax anti-settling agents and/or as cold flow inhibitors are described in EP-A-743972 and EP-A-743974, and the contents of these specifications are incorporated herein by reference.

Biofuel Instability Inhibitors as Stabiliser (iii)

Compounds suitable for use herein as stabiliser (iii) include biofuel instability inhibitors. These function mainly to disperse polymers or high molecular weight compounds either found in the biofuels as the bi-product of oxidation or thermal breakdown. A non exclusive list of chemistries which are applicable to perform this function include polymers of: ethylene and unsaturated esters; vinyl alcohols, vinyl ethers and their ester with organic acids; propylene, ethylene, isobutylene adducts with unsaturated carboxylic acids (such as maleic and fumaric acids) and their amide or imide derivatives; acrylic acids and their amide or esters derivatives; polystyrenes; and polymers made from combinations of these monomers. Additionally the compounds mentioned above as fuel antioxidants may be useful as biofuel instability inhibitors.

Blended Fuel or Separation Inhibitors as Stabiliser (iii)

Compounds suitable for use herein as stabiliser (iii) include blended fuel separation inhibitors.

A blended fuel separation inhibitor herein acts to maintain two or more fuels in a dispersed or blended form. Loss of uniformity and mobility of fuel may also occur when there is phase separation within such a fuel. Fuel blends may commonly in-tank be made when ships dock and may source whatever fuel is available at the locality at a favourable price. Lack of stability may occur, for example, when two or more different distilled fuels are blended, or when a biofuel is blended with a distilled fuel.

Many compounds as blended fuel separation inhibitors include compounds described above as stabilisers of other type, and need not be repeated here.

A further possible class of useful compounds in achieving the benefits of the present invention is fuel detergents, well known to the skilled person. Detergents could themselves be used as component (iii) or could be used in addition to another stabiliser.

Additive Composition

In a preferred aspect, in the additive composition the metal compound (i) is bis-cyclopentadienyl iron, the organic compound (ii) is camphor and the stabiliser (iii) is the reaction product of a $C_{8-24}$ alkyl-substituted phenol and an aldehyde, preferably the reaction product of an $C_{9-29}$ alkyl-substituted phenol and formaldehyde.

Preferably the additive composition is a liquid. The additive composition may further comprise a diluent.

It is convenient for the additive composition to be added as a solution of the active components in a diluent. It is preferable for such solutions to exhibit a high concentration of the active components in the diluent. The diluent to be used should be readily fuel soluble and compatible, including with respect to boiling point range, and preferably will have a flash point in excess of 62° C. for ease of storage. Ideal diluents are those in which all the active ingredients dissolve equally well and which form a solution which is stable over prolonged storage periods, and also under cold conditions.

However an additive composition is solid form (or components thereof, when provided separately) is not excluded, in the present invention.

A preferred additive composition containing the three components (i), (ii) and (iii) comprises:

3-1000 parts (i), preferably 10 to 500 parts (i), preferably 50 to 200 parts (i), preferably 100 parts (i)

to 3 to 600 parts (ii), preferably 10 to 200 parts (ii), preferably 20 to 100 parts (ii), preferably 35 to 70 parts (ii)

and to 1 to 10000 parts (iii), preferably 15-300 parts (iii), preferably 30 to 150 parts (iii); preferably 50 to 120 parts (iii).

Where the additive combination is intended to be added as an 'aftermarket' treatment, the volume of diluent used will be such as to provide a non-viscous liquid, suitable for use in a dispenser bottle or syringe pack.

Preferably the diluent is selected from an aromatic compound, a hydrocarbon compound and mixtures thereof. Generally the diluent may be a crude oil distillation product selected from kerosene, cracked gas oil, vacuum gas oil, long residue, short residue, heavy naptha, light gas oil, medium gas oil, heavy gas oil, cycle oil, gasoline, diesel and mixtures thereof.

The diluent may be a "paraffin compound", which may include both straight chain and branched chain compounds. The branched chain compounds are also known as iso-paraffins.

Preferably the diluent is a vacuum gas oil. In one preferred aspect the diluent is a light vacuum gas oil. By the term "light vacuum gas oil" it is typically meant a gas oil fraction from a vacuum distillation tower, which will typically have a boiling range of 350-630° C.

Although separate addition of components is not excluded (i.e. (i)+(ii)+(iii); or (i)/(ii)+(iii); or (i)/(iii)+(ii); or (ii)/(iii)+(i)) and may in some circumstances be convenient, it is envisaged that components (i), (ii) and (iii) will be added as an additive composition or package containing each of the components, i.e. (i)/(ii)/(iii).

The advantages of an additive composition are quite clear. Fuels to which no additive has been added can be transformed into fuel compositions according to the invention, by adding a corresponding quantity of the additive composition to the hydrocarbon mixture and preferably mixing it so that it is homogeneous. It would also be possible to add corresponding amounts of components (i), (ii) and (iii) separately to the mixture. However, it would not only be necessary to ensure the concentrations of each in the fuel, but also the correct relation of the individual components to one another. Therefore it is simpler and more customer-friendly to offer an additive composition which already contains the components in the correct relation to one another.

Fuel

In one aspect of the present invention, the fuel is preferably selected from the fuel is selected from bio-fuel, diesel, gasoline, marine fuel, bunker fuel, residual fuel, heating oil, middle distillate oil and heavy fuel oil; and including GTL (gas-to-liquid), CTL (coal-to-liquid), BTL (biomass-to-liquid), and OTL (oil sands-to-liquid). The fuel may be a mixed fuel e.g. a petroleum fuel mixed with a biofuel (for example conventional diesel and biodiesel); or a distilled fuel mixed with a different distilled fuel. However this list of fuels is to be regarded as non-limiting.

In a further aspect, the fuel is a middle distillate oil or a heavy fuel which is marine fuel, bunker fuel or heating oil.

The fuel may be gas oil or heating oil, including recycled light heating oil.

Marine fuel may be marine diesel fuel, marine distillate fuel or marine gas oil.

Preferably the fuel is a liquid having a viscosity of at least 1 cSt, preferably at least 10 cSt, preferably at least 80 cSt, preferably at least 100 cSt, preferably at least 120 cSt. In some embodiments useful as marine fuels the viscosity may be at least 360 cSt, preferably 450 cSt, at 40° C.

Preferably the fuel is a liquid having a viscosity of up to 1000 cSt, up to 800 cSt, preferably up to 700 cSt, preferably at up to 600 cSt, preferably up to 560 cSt, preferably up to 520 cSt, at 40° C.

For the purposes of this definitions of viscosity in this specification the reference temperature is 40° C. and viscosity is as measured by the procedure of ISO 3104:1994.

Fuel Composition

Preferably the fuel composition comprises at least 3 ppm of the metal compound (i), preferably at least 5 ppm, preferably at least 10 ppm, preferably at least 15 ppm, preferably at least 20 ppm.

Preferably the fuel composition comprises 1000 ppm or less of the metal compound (i), preferably 400 ppm or less, preferably 200 ppm or less, preferably 100 ppm or less, preferably 50 ppm or less.

Preferably the fuel composition comprises the metal compound (i) in an amount sufficient to provide at least 0.1 ppm of the metal, preferably at least 2 ppm, preferably at least 3 ppm, preferably at least 6 ppm.

Preferably the fuel composition comprises the metal compound (i) in an amount to provide 350 ppm or less of the metal, preferably 140 ppm or less, preferably 60 ppm or less, preferably 30 ppm or less, preferably 15 ppm or less.

If, for example, the metal compound (i) is ferrocene, then 30 ppm of ferrocene is an amount sufficient to provide about 10 ppm of the metal (iron). Thus, if the fuel composition comprises a metal compound (i) in an amount sufficient to provide 10 ppm of the metal, it would be present in an equivalent amount to 30 ppm of ferrocene.

Preferably the fuel composition comprises at least 1 ppm of the organic compound (ii), preferably at least 3 ppm; preferably at least 5 ppm, preferably at least 8 ppm, preferably at least 12 ppm.

Preferably the fuel composition comprises 600 ppm or less of the organic compound (ii); preferably 200 ppm or less, preferably 100 ppm or less; preferably 50 ppm or less, preferably 25 ppm or less.

Preferably the fuel composition contains at least 0.1 ppm of the stabiliser (iii), preferably at least 1 ppm, preferably at least 5 ppm, preferably at least 10 ppm, preferably at least 15 ppm, preferably at least 18 ppm, preferably at least 20 ppm.

Preferably the fuel composition contains 1000 ppm or less of the stabiliser (iii), preferably 320 ppm or less, preferably 160 ppm or less, preferably 80 ppm or less, preferably 40 ppm or less.

In accordance with the present invention there is provided a fuel composition comprising a fuel composition comprising a fuel containing:

(i) 3 to 1000 ppm (preferably 5 to 400, preferably 10 to 200 ppm, preferably 15 to 100 ppm, preferably 20 to 50 ppm) of a metal compound selected from an iron compound, a manganese compound, a calcium compound, a cerium compound, and mixtures thereof;

(ii) 1 to 600 ppm (preferably 3 to 200 ppm, preferably 5 to 100 ppm; preferably 8 to 50 ppm, preferably 12 to 25 ppm) of an organic compound selected from a bicyclic monoterpene, substituted bicyclic monoterpene, adamantane, propylene carbonate and mixtures thereof; and (iii) 0.1 to 1000 ppm (preferably 1 (or 5, or 10) to 320 ppm, preferably 15 to 160 ppm, preferably 18 to 80 ppm, preferably 20 to 40 ppm) of a stabiliser.

The concentration of a component (i), (ii) and (iii) in the fuel composition in principle is the sum of the amount of the respective components (i), (ii) or (iii) added (called the treat rate) and of any amount of corresponding component which was already present in the fuel, whether naturally or as a result of separate addition. Separate addition may have been made as part of an additive package made for a different purpose, for example.

In most practical situations, however, the concentration of a component present is substantially equal to the treat rate and the definitions given above for amounts of components (i), (ii) and (iii) in the fuel composition may be regarded as the amounts added to the fuel; that is, to the treat rate.

In this specification the amounts which are stated for components are always by weight.

According to the invention the components, preferably the additive composition, may be added to the fuel prior to or at the point of combustion. The addition may be made at any stage in the fuel supply chain (for example, at the refinery or distribution terminal) or may be via a dosing device associated with the combustion system, for example, on-board the vehicle. If a dosing device is used the addition may be either to the fuel or even separately direct into the combustion chamber or inlet system. Addition to the fuel may be in the combustion system's fuel tank by the user; a so-called 'after-market' treatment.

Preferably the majority of the hydrocarbons contained in the hydrocarbon mixture are petroleum derived. However, the hydrocarbon mixtures can also contain other natural or renewable materials, such as, for example, rapeseed oil methyl ester. Biofuels may be used.

Further Additives

The additive concentrate and/or the fuel may further comprise further additives, such as performance-enhancing additives. A non-limiting list of such further additives includes corrosion inhibitors, rust inhibitors, gum inhibitors, solvent oils, anti-static agents, dyes, anti-icing agents and detergents.

Combustion System

Preferably the combustion system is selected from a burner, engine and furnace.

Preferably the combustion system is selected from a burner and a furnace.

Preferably the combustion system is an engine, preferably a ship's engine. Preferably the engine is a compression ignition engine (diesel engine).

Benefits

The additive composition allows the fuels, of relatively high viscosity and with a propensity to separate in transportation or storage and to burn "dirty" previously (leading to coking of engine parts and exhaust equipment and smoky exhaust gases), to be used successfully.

Specific benefits include:

stabilisation of the fuel, even a blended fuel, including maintenance of suitable properties for efficient delivery and combustion;

reduction of soot content and ash content of an exhaust of a combustion system;

reduction in maintenance down-times, longer operational periods between down-times;

improvement of combustion efficiency of a combustion system;

improvement of fuel economy of a combustion system;

ability to select a fuel previously thought unsuitable per se, or previously thought unsuitable to blend with a fuel already in the fuel tank;

ability to use whatever fuel is available on the market at a given time.

In this specification preferred features of any aspect are preferred features of all other aspects unless that the particular situation or context makes that impossible.

The invention will now be further described, by way of example, with reference to the following embodiments.

EXAMPLE 1

Marine Fuel Test (Ship)

The following compositions were employed in a ship for a period of six months under confidential conditions, as additives to the fuel. The fuel was blended marine fuel of viscosity 140 cSt (measured at 40° C. by the procedure of ISO 3104: 1994). Previously the vessel ran on marine fuel of 60 cSt (measured at 40° C. by the procedure of ISO 3104:1994). The 140 cSt fuel, as well as being more viscous than the 60 cSt, contained more impurities, and had an increased tendency to separate or sediment in storage, and form soot combustion, which it may leave as coke deposits in the engine and downstream, especially in heat recovery equipment, leading to serious efficiency losses therein or breakdown thereof; and which may also appear as smoky exhaust.

Ferrocene—added at a concentration of 30 ppm of ferrocene, in the marine fuel

Camphor—added at a concentration of 15 ppm of camphor, in the marine fuel (provided in a hydrocarbon solvent)

Stabiliser, namely the ester reaction product of a $C_{20-24}$ alkylphenol and formaldehyde—added at a concentration of 25 ppm of the ester in the marine fuel (provided in a hydrocarbon solvent).

The vessel was a mixed passenger/cargo ship of gross tonnage 6090 tonnes. It had two Mitsubishi Mon 18V 40/54 main engines, each more than 30 years old and with a tendency to smoke. Rated speed was 20,000 Ps/430 rpm. Average fuel consumption was about 825 liters 380 cSt marine fuel/hour per engine. The vessel had three Daihatsu 6PSHTc-26D auxiliary engines. Rated speed was 765 Ps/720 rpm. Average fuel consumption was 100 liters/hour per auxiliary engine.

The vessel was selected because at the end of the trial it was due to be layered over and dry-docked.

The compositions were added to the fuel tank in the calculated amounts each time the ship was refuelled with 140 cSt fuel.

The nature of the trial—a real-life sea trial rather than a laboratory test—meant that "scientific" data on soot content, ash content etc. was not obtained. On the other hand the empirical observations of the results of a trial involving six-months at sea have "real-life" value.

The 140 cSt fuel, not being designated for the task undertaken was cheaper than the 60 cSt fuel.

It was observed that the additives allowed the 140 cSt fuel to be used without problem, in place of the 60 cSt fuel. They appeared to render it suitably fluid without settlement or separation, and to prevent/suppress undesirable soot and ash formation.

No detrimental effects were noted during the period of the trial to any engine parts, fuel injectors, turbochargers or heat recovery equipment.

Furthermore the exhaust gases were relatively clear. In fact, with the old engines in the ship used for the trial no marine fuel would even give a completely clear exhaust. Even the 60 cSt fuel would give some smoking. It was observed that the 140 cSt fuel without additives gave a smoky exhaust but that the 140 cSt fuel with the additives gave a less smoky exhaust than the 60 cSt fuel—a highly impressive result. We consider that with modern engines a clear exhaust could be obtained.

Furthermore the 140 cSt fuel has a higher energy rating than the 60 cSt fuel and so led to a 10% reduction in average fuel consumption, from 825 to 750 liters per hour per main engine. This represents a large cost saving additional to the saving per tonne in fuel purchase costs.

We regard these results very surprising. It was expected that there would be some negative effects, to set against the positive economic benefit that this cheaper, heavier fuel could be used.

EXAMPLE 2

Heating Fuel Tests

Test Equipment:

Steel heating boiler: Ruhr Brenner, Model B 4T/14021 kW, Year of Manufacture 1996

Heat output: Set at 20 kW

Oil burner: Ruhr Brenner, Model RH-4, 12-45 kW, Year of Manufacture 1996

Jet (nozzle): Danfoss Typ H, 0.50 US gallons per hour (1.87 kg/h), 60° H

° H is the index angle/spraying index, hollow cone

Smoke tester Brigon Smoke Tester.

For the trial, the burner pump was set to single-line mode, which obviates return of oil to the containers and therefore heating by the burner pump.

The change from one test fuel to another was achieved by switching over a three-way valve immediately in front of the burner. Because of the three-way valve and the single-line circuit is it ensured that incorrect measurements caused by additive residues in the pipeline cannot occur. The respective soot measurements were pulled through a Bacharach soot pump and evaluated by means of visual inspection and measurement with a soot number test device.

EXAMPLE 2A

Embodiment A

The steel hot water boiler was brought up to operating temperature with heating oil without additives and without any biofuel. A smoke spot number of approximately 3 was set by throttling the air feed to the burner.

The duration of the trial was approximately 0.75 hours, and then the smoke spot number was measured.

Then, heating oils containing a biofuel, rapeseed oil, were tested using this burner in order to measure the effect of the biofuel component.

The soot number was measured by evacuation (extraction suction with a manual smoke tester of a defined partial gas volume through a filter pad. This filter pad was judged optically (by comparison) after the measurement. The soot number average value is a result of 10 individual measurements.

| Test | % Biofuel component | Bacharach Soot No. | Increase in Soot No |
|---|---|---|---|
| 1 | 0% wt/wt | 3.27 | — |
| 2 | 10% wt/wt | 3.91 | 0.64 |
| 3 | 15% wt/wt | 4.71 | 1.44 |

EXAMPLE 2B

Embodiment B

In this embodiment, the effect of additives on a fuel containing a biofuel component was determined. Using the same equipment and protocol as "second illustration, embodiment A", the initial smoke spot number with a heating oil without additives but containing 5% biofuel (rapeseed oil methyl ester) was set to approximately 3 by altering the burner to the point where measurable smoke is produced.

Then the same fuel was tested containing Additives A and B identified below at addition rates of 1 liter additive to 2000 liters of fuel.

Additive A

A combination of additives added in hydrocarbon solvent which when added at the above addition rate delivers the following active components:

Ferrocene: 0.5 ppm w/w

Camphor: 40 ppm w/w

Stabiliser 1: 20 ppm w/w—a copolymer of lauryl methacrylate and dimethylaminoethylmethacrylate Stabiliser 2: 37 ppm w/w—a mixture of mono-, di- and tri-tertiary-butyl phenols Stabiliser 3: 17 ppm w/w 2,6-ditertiary-butyl-4-methyl phenol Additive B A combination of additives added in hydrocarbon solvent which when added at the above addition rate delivers the following active components:

Ferrocene: 0.5 ppm w/w

Camphor: 40 ppm w/w

Stabiliser 1: 20 ppm w/w—a copolymer of lauryl methacrylate and dimethylaminoethylmethacrylate Stabiliser 2: 37 ppm w/w—a mixture of mono-, di- and tri-tertiary-butyl phenols Stabiliser 3: 17 ppm w/w—2,6-ditertiary-butyl-4-methyl phenol Stabiliser 4: 118 ppm w/w—Cold flow improver Ethylene vinyl acetate copolymer Stabiliser 5: 22.5 ppm w/w—post reacted olefin maleic anhydride copolymer (a wax anti-settling agent)

| Test | % Biofuel Component | Additive | Bacharach Soot No. | Decrease in Soot No |
|---|---|---|---|---|
| 4 | 5% wt/wt | — | 2.85 | — |
| 5 | 5% wt/wt | A | 2.08 | 0.77 |
| 8 | 5% wt/wt | B | 2.05 | 0.80 |

EXAMPLE 3

Marine Fuel Tests

Test Equipment:

Engine Type: Caterpillar 6 M20 (formerly MAK)

Technical Data

| | 6 M20 |
|---|---|
| Engine Type | Direct Injection<br>4 Stroke<br>Turbo Charged |
| Stroke [mm] | 300 |
| Diameter [mm] | 200 |
| Piston displacement [$dm^3$] | 56.4 |
| Compression ratio | 14.8 |
| Maximum Power per cylinder [kW] | 170 |
| Maximum pressure [MPa] | 18 |
| RPM | 1000 |
| Start of Injection [° BTDC] | 14.5 |
| Piston rod length [mm] | 552 |

Test Conditions:

In these tests, the engine was run at a constant speed of 1000 rpm under various load conditions between 0 kW and 850 kW.

Fuels:

Analysis of Fuels

| Characteristic | Fuel 1 | Fuel 2 |
|---|---|---|
| Calculated Carbon Aromaticity index (CCAI) | 821 | 856 |
| Density at 15° C. [$kg/m^3$] | 942.6 | 992.1 |
| Density at 50° C. [$kg/m^3$] | 919.2 | 967.3 |
| Viscosity at 40° C. [$mm^2/s$] | 83.6 | 276.4 |
| Viscosity at 50° C. [$mm^2/s$] | 52.7 | 146.7 |
| Pourpoint [° C.] | −20 | −15 |
| Ash Content [% mm] | 0.042 | 0.040 |

-continued

| Characteristic | Fuel 1 | Fuel 2 |
|---|---|---|
| Flashpoint | 79 | 92 |
| C - mm % | 83.77 | 85.00 |
| H - mm % | 11.19 | 10.41 |
| Sulphur mm % | | 0.82 |

Fuel 1: "Clean" test fuel blend prepared by diluting a 580 cSt blending stock with marine diesel fuel to give a fuel with a CCAI value of 821 and a viscosity of approximately 85 cSt at 40° C.
Fuel 2: "Dirty" test fuel blend prepared by diluting the same 580 cSt blending stock with light cycle oil to give a fuel with a CCAI value of 856 and a viscosity of approximately 275 cSt at 40° C.
Fuel 3: Same fuel blend as Fuel 2 but containing additive package as described below.

Additive Composition:

Ferrocene—added at a concentration of 33 ppm of ferrocene, in Fuel 3

Camphor—added at a concentration of 13 ppm of camphor, in Fuel 3 (provided in a hydrocarbon solvent)

Dispersant, namely the ester reaction product of a C20-24 alkylphenol and formaldehyde—added at a concentration of 25 ppm of the ester in Fuel 3 (provided in a hydrocarbon solvent)

Measurements:

The following measurements were made:

Exhaust Emissions:

Particulates (mg of particulates per kg of exhaust—using AVL Smartsampler and gravimetric determination)

Total Hydrocarbons (ppm volume by FID)

Oxygen (% volume in exhaust by paramagnetic analysis)

Carbon Monoxide (ppm volume in exhaust by IR absorption)

Heat Release (J/°) vs Crank Angle (°)

Exhaust Emissions

Particulates (mg/kg):

| Power (kW) | Fuel 1 | Fuel 2 | Fuel 3 |
|---|---|---|---|
| 850 | 30.0 | 52.3 | 46.9 |
| 750 | 48.9 | 51.0 | 45.3 |
| 500 | 31.8 | 60.1 | 63.3 |
| 250 | 43.1 | 72.6 | 73.8 |
| 0 | 109.4 | 368.3 | 159.4 |

Total Hydrocarbons (ppm):

| Power (kW) | Fuel 1 | Fuel 2 | Fuel 3 |
|---|---|---|---|
| 850 | 101 | 95 | 94 |
| 750 | 124 | 123 | 112 |
| 500 | 182 | 152 | 138 |
| 250 | 141 | 174 | 189 |
| 0 | 401 | 1400 | 696 |

Oxygen (%):

| Power (kW) | Fuel 1 | Fuel 2 | Fuel 3 |
|---|---|---|---|
| 850 | 12.74 | 12.75 | 12.51 |
| 750 | 13.12 | 12.83 | 12.71 |
| 500 | 13.79 | 13.26 | 13.25 |
| 250 | 14.12 | 14.20 | 13.88 |
| 0 | 17.02 | 16.92 | 16.79 |

Carbon Monoxide (ppm):

| Power (kW) | Fuel 1 | Fuel 2 | Fuel 3 |
|---|---|---|---|
| 850 | 169 | 134 | 156 |
| 750 | 245 | 138 | 138 |
| 500 | 515 | 158 | 132 |
| 250 | 328 | 305 | 331 |
| 0 | 530 | 965 | 739 |

These results indicate that Fuel 3 gives a lower particulate level than Fuel 2 at high power and especially under zero load conditions. Also, Fuel 3 gives more complete combustion that Fuel 2, particularly at low load.

Heat Release (J/°) vs Crank Angle (°) Test

Fuel is injected at 14.5° before top dead centre of the cycle. The heat release plotted against crankshaft angle then gives a measure of Ignition Delay.

FIG. 1 shows this for the low load condition (0 kW) for the three fuels.

The heat release curves show that under these load conditions, the "dirty" Fuel 2 had a significantly longer, and undesirable, ignition delay when compared to the "clean", Fuel 1.

The additised Fuel 3 had an improved ignition delay compared to the Fuel 2.

This effect would be expected to be most significant under startup, warmup and low load conditions.

The invention claimed is:

1. A method of improving the combustion of a fuel composition in a combustion system with an exhaust, comprising providing a benefit selected from the group consisting of:

stabilizing the fuel, or stabilizing a blended fuel comprising maintaining suitable properties for efficient delivery and combustion;

reducing soot content and ash content of an exhaust of a combustion system;

improving combustion efficiency of the combustion system;

reducing maintenance down-times and increasing operational periods between down-times;

improving fuel economy of the combustion system;

allowing selection of a fuel previously thought unsuitable per se or previously thought unsuitable to blend with a fuel already in the fuel tank; and allowing selection of whatever fuel is available on the market at a given time;

the method comprising providing a fuel and adding to the fuel an additive composition comprising:

(i) a metal compound selected from the group consisting of an iron compound, a manganese compound, a calcium compound, a cerium compound, and mixtures thereof;

(ii) an organic compound selected from the group consisting of a bicyclic monoterpene, substituted bicyclic monoterpene, adamantane, propylene carbonate and mixtures thereof; and (iii) a stabilizer selected from the group consisting of an asphaltene dispersant, a cold flow improver, a wax anti-settling additive and mixtures thereof; and combusting the fuel composition.

2. The method of claim 1, wherein component (i) is an iron complex selected from the group consisting of bis-cyclopentadienyl iron; substituted bis-cyclopentadienyl iron; over-based iron soaps; and mixtures thereof.

3. The method of claim 2, wherein component (i) is ferrocene.

4. The method of claim 1, wherein component (ii) is a bicyclic monoterpene or substituted bicyclic monoterpene selected from the group consisting of camphor, camphene, isobornyl acetate, dipropyleneglycol-isobornyl ether, adamantane, propylene carbonate; and mixtures thereof.

5. The method of claim 4, wherein component (ii) is camphor.

6. The method of claim 1, wherein the asphaltene dispersant is a phenolic resin of formula (xi):

(xi)

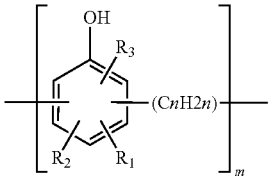

wherein m is at least 1; wherein n is at least 1; wherein the or each $R^1$, $R^2$ and $R^3$ are independently selected from the group consisting of hydrogen, alkyl groups, aromatic groups and heterocycles, OH, hydrocarbyl groups, oxyhydrocarbyl groups, —CN, $NO_2$, —$SO_3H$, —$SO_2H$, —COOH, —$COOR^4$, —$NH_2$, —$NHR^5$, —$SO_2NH_2$, —$SO_2$, —$NHR^6$, $CONH_2$, $CONHR^7$, SH and halogens; and wherein each of $R^4$, $R^5$, $R^6$ and $R^7$ is independently selected from hydrocarbyl groups.

7. The method of claim 1, wherein (iii) is a cold flow improver or wax anti-settling additive selected from the group consisting of:

copolymers containing di(C1-4 alkyl)amino (C1-4 alkyl) acrylate or methacrylate units;

copolymers of alkenes and unsaturated esters, alkylmethacrylate polymers, polyoxyalkylene esters, ethers, ester/ethers;

maleic anhydride olefin copolymer additives prepared by the reaction of maleic anhydride with an α-olefin; and imides produced by the reaction an alkyl amine, maleic anhydride and α-olefin.

8. The method of claim 1, wherein components (i), (ii) and (iii) are present in the following relative amounts by weight; 3-1000 parts (i) to 3 to 600 parts (ii) and to 1 to 10000 parts (iii).

9. The method of claim 1, wherein the fuel is selected from bio-fuel, diesel, gasoline, marine fuel, bunker fuel, heating oil, middle distillate oil and heavy fuel oil; and including GTL (gas-to-liquid), CTL (coal-to-liquid), BTL (biomass-to-liquid), and OTL (oil sands-to-liquid); and including blends containing one more such fuels.

10. The method of claim 1, wherein the fuel composition comprises at least from 3 ppm to 1000 ppm of the metal compound (i).

11. The method of claim 1, wherein the fuel composition comprises from 1 ppm to 600 ppm of organic compound (ii).

12. The method of claim 1, wherein the fuel composition comprises from 0.1 ppm to 1000 ppm of the stabilizer (iii).

13. The method of claim 1, wherein the fuel composition is a liquid having a viscosity of at least 1 cSt at 40° C.

14. The method of claim 13, wherein the fuel composition is a liquid having a viscosity of at least 80 cSt at 40° C.

15. The method of claim 14, wherein the fuel composition is a liquid having a viscosity of at least 360 cSt at 40° C.

16. The of claim 15, wherein the fuel composition is a liquid having a viscosity of up to 1000 cSt at 40° C.

* * * * *